US005306350A

United States Patent [19]

Hoy et al.

[11] Patent Number: 5,306,350

[45] Date of Patent: Apr. 26, 1994

[54] METHODS FOR CLEANING APPARATUS USING COMPRESSED FLUIDS

[75] Inventors: Kenneth L. Hoy, St. Albans; Kenneth A. Nielsen, Charleston, both of W. Va.

[73] Assignee: Union Carbide Chemicals & Plastics Technology Corporation, Danbury, Conn.

[21] Appl. No.: 874,521

[22] Filed: Apr. 27, 1992

Related U.S. Application Data

[62] Division of Ser. No. 631,406, Dec. 21, 1990, abandoned.

[51] Int. Cl.[5] ..... B08B 9/00; B08B 9/06

[52] U.S. Cl. ..... 134/22.14; 134/11; 134/22.19

[58] Field of Search ..... 134/11, 22.14, 22.19

[56] References Cited

U.S. PATENT DOCUMENTS

| | | | |
|---|---|---|---|
| 3,740,267 | 6/1973 | Haylock | 134/22.14 |
| 3,762,952 | 10/1973 | Gouin et al. | 134/22.14 |
| 4,124,528 | 11/1978 | Modell | 252/411 |
| 4,189,914 | 2/1980 | Marek et al. | 60/726 |
| 4,375,387 | 3/1983 | deFilippi et al. | 202/169 |
| 4,582,731 | 4/1986 | Smith | 427/421 |
| 4,619,735 | 10/1986 | Norton | 162/135 |
| 4,734,227 | 3/1986 | Smith | 264/13 |
| 4,734,451 | 3/1986 | Smith | 524/493 |
| 4,737,384 | 4/1988 | Murthy et al. | 427/369 |
| 4,875,941 | 10/1989 | Piotrowski et al. | 134/11 |
| 4,882,107 | 11/1989 | Cavender et al. | 264/51 |
| 4,923,720 | 5/1990 | Lee et al. | 427/422 |
| 4,944,837 | 7/1990 | Nishikawa et al. | 156/656 |
| 5,009,367 | 4/1991 | Nielson | 239/3 |
| 5,013,366 | 5/1991 | Jackson et al. | 134/2 |
| 5,066,522 | 11/1991 | Cole et al. | 427/422 |
| 5,073,203 | 12/1991 | Al-Ghatta | 134/11 |
| 5,108,799 | 4/1992 | Hoy et al. | 427/422 |

FOREIGN PATENT DOCUMENTS

| | | | |
|---|---|---|---|
| 2603664 | 8/1977 | Fed. Rep. of Germany | B65B 31/02 |
| 2853066 | 6/1980 | Fed. Rep. of Germany | B05D 1/22 |
| 55-84328 | 6/1980 | Japan | C08J 2/02 |
| 58-168674 | 10/1983 | Japan | C09J 3/14 |
| 59-16703 | 1/1984 | Japan | B27K 3/52 |
| 62-152505 | 7/1987 | Japan | B01D 9/02 |
| 868051 | 4/1988 | South Africa . | |

OTHER PUBLICATIONS

Francis, A. W., "Ternary Systems of Liquid Carbon Dioxide", J. Phys. Chem. 5B:1099, Dec. 1954.

Smith, R. D., et al., "Direct Fluid Injection Interface for Capillary Supercritical Fluid Chromatography-Mass Spectrometry" J. Chromatog. 247 (1982):231-243.

Krukonis, V., "Supercritical Fluid Nucleation of Difficult-to-Comminute Solids", paper presented at 1984 Annual Meeting, AIChE, San Francisco, Calif., Nov. 25-30, 1984.

(List continued on next page.)

*Primary Examiner*—Asok Pal

*Attorney, Agent, or Firm*—J. F. Leightner

[57] ABSTRACT

The application contains subject matter related to cleaning mixtures and methods for using such cleaning mixtures to clean apparatus which contain one or more polymeric compounds wherein said cleaning mixture is comprised of at least one compressed fluid and at least one active solvent in which said at least one or more polymeric compounds are at least partially soluble and which is at least partially miscible with the at least one compressed fluid, said compressed fluid being a gas at standard conditions of 0° C. and one atmosphere (STP), which cleaning mixture is in one phase and at a pressure at which the cleaning mixture is substantially near its two phase region.

44 Claims, 6 Drawing Sheets

OTHER PUBLICATIONS

Dandge, D. K. et al., "Structure Solubility Correlations; Organic Compounds and Dense Carbon Dioxide Binary Sytems". Ind. Eng. Chem. Prod. Res. Dev. 24: 162-166 (1985).

Matson, D. W. et al., "Production of Powders and Films by the Rapid Expansion of Supercritical Solutions", J. Materials Science 22: 1919-1928 (1987).

McHugh, M. A. et al., "Supercritical Fluid Extraction, Principles and Practice", Butterworth Publishers (1986) Contents and Appendix.

Cobbs, W. et al., "High Solids Coatings Above 80% by Volume", Water-Borne & High Solids Coatings Symposium, Mar. 1980.

Matson, D. W. et al., "Production of Fine Powders by the Rapid Expansion of Supercritical Fluid Solutions", Advances in Ceramics vol. 21, pp. 109-121 (1987).

Kitamura, Y., et al., "Critical Superheat for Flashing of Superheated Liquid Jets", Ind. Eng. Chem. Fund. 25: 206-211 (1986).

Petersen, R. C. et al., "The Formation of Polymer Fibers From the Rapid Expansion of SCF Solutions" Pol. Eng. & Sci (1987) V. 27 p. 16.

METHODS FOR CLEANING APPARATUS USING COMPRESSED FLUIDS

This application is a division of prior U.S. application: Ser. No. 07/631,406 Filing Date Dec. 21, 1990 now abandoned.

RELATED PATENTS AND APPLICATIONS

The application contains subject matter related to U.S. Pat. No. 4,882,107, issued Nov. 21, 1989, and U.S. Pat. No. 4,923,720, issued May 8, 1990. This application also contains subject matter related to U.S. patent applications Ser. No. 218,896, filed Jul. 14, 1988 now abandoned. Ser. No. 218,910, filed Jul. 14, 1988 now U.S. Pat. No. 5,108,799 Ser. No. 326,945, filed Mar. 22, 1989 now U.S. Pat. No. 5,066,522 Ser. No. 327,273, filed Mar. 22, 1989; Ser. No. 327,274, filed Mar. 22, 1989 now both abandoned. Ser. No. 327,275, filed Mar. 22, 1989 now U.S. Pat. No. 5,009,367 Ser. No. 327,484, filed Mar. 22, 1989; and Ser. No. 413,517, filed Sep. 27, 1989, now both abandoned.

FIELD OF THE INVENTION

The present invention is generally related to cleaning apparatus, particularly purging, flushing, and cleaning spraying apparatus. More specifically, it relates to methods for purging, flushing and cleaning a spray apparatus when changing from one material to another material to be sprayed, such as changing color or composition, or when spraying is finished or the apparatus is shut down or idled. It also relates to methods for flushing cleaning solutions from spray apparatus.

BACKGROUND OF THE INVENTION

While the following discussion will generally focus on purging, flushing and cleaning spray apparatus, it should readily be appreciated that the scope of the present invention is not limited to such apparatus. Indeed, its scope includes all apparatus in which it is capable to have a closed system so as to accommodate the compressed fluids which are utilized in the present invention.

Many materials are sprayed by a spray apparatus for different purposes, such as to apply the material to a surface, to foam the material, to disperse the material in droplet form into a gaseous carrier, to convert the material into particulate form, or to fabricate structural or composite materials. Materials that are spray applied onto a surface include coatings, adhesives, mold release agents, lubricants, detergents, insulation, herbicides, and the like. Materials that are spray foamed include flexible and rigid foamed plastics, foam rubber, foam insulation, and the like. Materials that are spray dispersed into a gaseous carrier such as air include fuels, pesticides, aerosols, and the like. Materials that are sprayed into particulate form include plastic microspheres, microballoons, spray-dried materials, and the like. Materials that are spray fabricated include structural plastics, reinforced plastics, filled composites, laminates, circuit boards, moldings, acoustical materials, carpet backing, coverings, insulation, and the like.

Extrusion in a fundamental sense is a similar operation to spraying in that material is passed through an orifice under pressure in order to apply it to something or to change its form for some purpose. The main difference is that the material is cohesive enough that it remains intact after passing through the orifice instead of subdividing into a spray of droplets. However, extrusion apparatus and spray apparatus are very similar in that they both provide pressurized material to the orifice and the material must be rendered fluid enough to pass through the orifice. Both types of apparatus utilize material supply systems, pumps, metering devices, flow control devices, heaters, tubing, and the like, and a spraying or extrusion device. Both operate under pressure and must be built accordingly. Both often use reactive materials. Both must be cleaned periodically to maintain proper operation. Often the same apparatus can be used for both spraying and extrusion by merely changing the material and the application orifice. Accordingly, in the present invention, the terms spraying, sprayed, and spray apparatus are understood to encompass within its scope, extrusion, extruded, and extrusion apparatus, respectively.

Many materials are extruded by an extrusion apparatus for different purposes, such as to apply a material to a surface, to form fibers or films, to fabricate structural or composite materials, or to fill voids such as a mold. Materials that are extrusion applied to a surface include sealants, caulks, adhesives, and viscous lubricants and greases. Materials that are extruded into fiber or film form include polymers used to make synthetic solid and hollow polymeric fibers, membranes, and plastic and photographic films, and the like. Materials that are extrusion fabricated include structural plastics, reinforced plastics, filled composites, laminates, moldings, coverings, insulation, and the like. Materials that are extruded to fill a mold include polymers used in injection molding, blow molding, and the like.

These materials often contain a solids or polymeric or hydrocarbonous fraction that is dissolved or dispersed in an organic solvent in order to liquify it or reduce its viscosity so that it can be sprayed. Or the material is heated in order to melt it or reduce its viscosity so that it can be sprayed. These materials often revert to their solid or highly viscous state as the organic solvent evaporates or the materials cool. Often the materials are reactive so that they solidify of their viscosity increases over time. Often different materials used in the same spray or extrusion apparatus are incompatible even at very low levels and contaminate each other if mixed. So too, the materials are often hazardous such as being toxic or flammable or unstable and therefore must not be left in the apparatus when it is idle, for safety reasons. For these and other reasons, the spray apparatus must be cleaned, that is, the material removed from the apparatus by dissolving or dispersing it in a cleaning solution, whenever the apparatus changes from spraying one material to another material or whenever spraying is finished or the apparatus is shut down or idled.

It is often also necessary to effectively remove conventional cleaning solution from a spray apparatus once cleaning has been effected, because the cleaning solution itself is incompatible with the next material to be sprayed or it is likewise hazardous. Contamination with cleaning solution may cause poor spray performance or poor product quality. Therefore, it is often desirable to flush the cleaning solution from the apparatus so that the apparatus is dry and free of cleaning solution before it is refilled with material to be sprayed.

To clean materials from spray apparatus, cleaning solutions consisting of one or more organic solvents are generally employed, due to their ability to dissolve organic materials. However, this leads to undesirable emission of organic solvent vapors into the atmosphere from such operations as filling and draining the apparatus, which saturates the air leaving and entering the apparatus with solvent vapor. Solvent vapors are emitted directly into the atmosphere when the solvent is sprayed from spray guns as they are flushed. In addition, air is often pulsed under pressure into the cleaning solution as it is fed into the apparatus in order to enhance cleaning action by increasing flow agitation and turbulence. These emissions cause air pollution and can be hazardous, because they expose workers to the vapors, and the cleaning solution is usually much more flammable than the material being sprayed. It is also much more susceptible to ignition by static discharge as it drains from the apparatus. Furthermore, the spent or used cleaning solution creates a large volume of hazardous waste material that must be transported and disposed of safely, which can be expensive.

Any cleaning solution left in the apparatus becomes mixed with the next material to be sprayed, so it is also emitted to the atmosphere. But drying the apparatus requires a large volume of air and often the air or apparatus is heated to increase the solvent vapor pressure, so more solvent is volatilized and emitted to the atmosphere and the vapors are more flammable.

In the liquid spray application of coatings, it is particularly true that the spray apparatus must be cleaned periodically during normal operation to prevent contamination or to prevent the coating material from setting up when the equipment is idle. The liquid spray application of coatings is effected mainly through the use of organic solvents as viscosity reduction diluents. However, as taught in the aforementioned related patent applications, supercritical fluids, such as supercritical carbon dioxide and supercritical nitrous oxide, have recently been found to be useful viscosity reducing diluents for the liquid spray application of viscous coating formulations, such as organic solvent-borne coatings and non-aqueous dispersion coatings, thereby markedly reducing the volume of environmentally undesirable organic diluents used for application. Supercritical fluids have similarly been found to be useful viscosity reducing diluents for the spray application of adhesives and also mold release agents such as waxes, oils, and greases. Supercritical fluids have also been found to have further utility as agents for creating feathered airless sprays and for creating wider airless sprays when spraying a variety of materials that also includes agricultural coatings, such as fertilizers and herbicides; chemical agents; lubricants; protective oils; non-aqueous detergents; and the like.

The aforementioned related applications also teach the addition of water to an active organic solvent-borne coating or adhesive composition such that when admixed with supercritical fluids, the water acts as an additional viscosity reduction diluent, which provides a composition having an even lower viscosity. This is surprising in that materials such as liquid or supercritical carbon dioxide are only sparingly miscible with water or water-borne polymer mixtures. In general, up to about 30 percent by weight of water, based on the total weight of solvent/diluent present, may be added without substantially reducing the amount of supercritical fluid that can be contained in the composition.

Usually, an organic coupling solvent is added in conjunction with the water addition, wherein it may indeed replace some of the nominal active organic solvent of the original composition, thereby maintaining the total amount of organic solvents in the water-containing composition at less than or equal to the amount contained in the original composition. Moreover, in some cases, even the total amount of volatile organic solvents needed can be reduced. The primary function of the coupling solvent is to enable a state to exist wherein all of the components in the composition mixture, namely the polymeric components, the water, and the active organic solvent (other than insoluble components such as pigments and the like) are in a single phase by virtue of its effect of creating miscibility or at least partial miscibility with one another of the components. The coupling solvent is a solvent in which the polymeric compounds used in the solids fraction is at least partially soluble, and is also at least partially miscible with water, thereby enabling miscibility of the solids fraction, the solvent fraction, and the water to the extent that a single phase is desirably maintained such that the composition may optimally be sprayed and a good coating or adhesive formed. The active organic solvents include those solvents which have particularly good solubility for the polymeric compounds that are used in the composition in addition to having at least partial miscibility with supercritical fluids.

Regardless of what liquid spray application is being practiced, even when using the improved technology, periodic cleaning is still essential for proper operation of the apparatus and for proper application of the coating. The problem is particularly acute in applications where colors or coating formulations are changed frequently, such as in industrial operations where articles or ware are to be spray coated at a spray station along a production or assembly line. When such operations require coating with a variety of colors, it is not generally realistic to have separate spray stations or production lines for each color, or even to spray a long line with one color and then change to another color, that is, to block operate by color. Therefore, it is more ideal to be able to make rapid color changes at a single spray station.

In many conventional systems, each color has its own supply container, feed pump, and feed system connected to a color control manifold, which is connected directly to the spray gun or other spray device. That is, each color has a redundant supply and feed system in parallel. Conventional process control devices, such as manual or automatic control valves, are operated manually or by a programmed automatic controller to give the proper sequence of colors for spraying and of cleaning solution and air for cleaning and purging the manifold and spray device. Although this type of color change system can readily spray a plurality of colors with a single spray device, there are economic disadvantages, mainly due to the large number of expensive pumps required. Another disadvantage arises from the time required to flush the manifold, which can become significant with high-solids coatings.

Many improvements are known to those skilled in the art, such as discussed, for example, in U.S. Pat. No. 4,337,282, issued Jun. 29, 1982, wherein the improvement embodies use of only two pumps, each connected to a color control manifold such that the pumps alternately supply different colors to the spray device, so that when one of the pumps is supplying material, the other is being cleaned. Nevertheless, much costly solvent is still needed and much hazardous waste is produced.

Another instance of a spray apparatus that experiences frequent color changes is automatic coating equipment on an automobile paint line, where color changes occur ordinarily from one automobile to the next as each automobile passes through the spray booth on a conveyor line. As discussed in U.S. Pat. No. 4,403,736, issued Sep. 13, 1983, a common technique is to use solvent at a relatively low superatmospheric pressure to flush the last of a quantity of coating of a given color from the spray apparatus and spraying device. The dilemma presented with this technique is that because of the relatively large capacity of the equipment, a large amount of spent solvent is expelled from the apparatus with high pressure air between each color change and is subsequently discarded. With several hundred such color changes per day per line in an automobile plant, a tremendous amount of hazardous waste is produced that contains organic solvents that are expensive, highly volatile, flammable, and toxic, so safety and environmental considerations are a concern, both inside the spray booth and in the air expelled to the environment. Furthermore, the large amount of hazardous waste generated by using said organic solvents must be contained, processed, and disposed of in an environmentally safe manner, which is also costly. It is apparent from the foregoing discussion that a reduction in the quantity of organic solvents used in said paint cleaning systems would be a significant benefit from economic, safety, environmental, and waste disposal considerations.

Improvements taught in the above-noted '736 patent include the following sequence at preprogrammed intervals: coating is supplied at a pressure of about 20 psia for a period of about 35 seconds; near the end of this period a valve is activated to introduce a "slug" of air at a slightly higher pressure for a few seconds to push the end of the first color from the manifold through the feed and spraying device; when the part being sprayed is past the spray apparatus, valves are activated supplying together a solvent and high-pressure air flush (at about 60 psig); finally, low pressure air is supplied to provide the next coating color.

Under certain conditions, however, the soft air push technique can experience difficulties. One can occur when electrostatic spray devices are used, which is quite common in the industry. As the coating material is pushed by air from inside the delivery tube, the coating material can break up and leave small pools inside the tube and on its wall. Because a different electrical potential can exist between these pools and the wall, arcing can occur. This can be hazardous because the coating and solvent vapors mix with the air and become combustible. Replacing the soft air push with a solvent push is taught as one solution to this problem. However, this increases the amount of solvent used, in turn leading to another embodiment, wherein a solvent system with vacuum capability is utilized to return solvent residing in the solvent delivery system to the supply tank, thereby conserving solvent, and in such a manner reducing the amount of solvent disposal required. Notwithstanding this approach, there still is a considerable amount of solvent being used in the solvent push and the solvent-high-pressure-air flush. It is clearly seen, if not for the hazard involved, the soft air push would undoubtedly be preferable because it minimizes solvent usage, costs, and the environmental impact.

In many industries there is a trend away from solvent based materials such as paints, lacquers, adhesives, and the like, in an effort to eliminate or reduce the amount of solvents discharged to the environment. In many instances these industries have gone to two component systems in which individual components are maintained separate through a metering process and only mixed and reacted just before application. As discussed in U.S. Pat. No. 4,265,858, issued May 5, 1981, these systems have suffered, however, from a lack of commercially available equipment for its application, particularly where several colors or materials are interchangeably applied through the same equipment. This patent calls attention to the fact that some provision must be made for completely purging the common equipment between the interchange of colors or materials. It further states that this purge must be made, for obvious reasons, with minimum loss of paint and time before this means becomes commercially acceptable. The lack of such quick color change apparatus has lessened the acceptance of this technology. The patent describes means and apparatus that are directed to solving this dilemma. In the methods and apparatus disclosed, the simultaneous matering and delivery of several metered flowable materials, in predetermined portions to a mixing device, is provided by animproved modular control system for promoting rapid interchanging of the flowable material. Wherein, when it is desirable to change colors, a control valve is actuated to cause solvent to flow through the common elements of the system to purge these elements of the old material after its flow is shut off. The solvent is delivered to a solvent aspirator wherein high pressure air is also introduced. The solvent-air mixture then flows through the common passages of the paint manifold, the mixer, and to the gun. In most instances after the gun is purged, the flush bypasses said gun exiting the system through a dump valve positioned adjacent to the gun. After the solvent purge, the new differently colored material is caused to flow into the manifold. Here again large amounts of purge solvent must be handled with all of the aforementioned disadvantages.

Other means and apparatus have been developed to operate in the liquid urethane paint industry wherein two component systems, one a color component and the other a catalyst component, are relatively stable until combined just prior to application. One of the consequences of this highly reactive mixture is its short pot life, thereby requiring purging of this part of the system of residue every few minutes; otherwise, the system will eventually become inoperable. This requires that special handling, mixing, and solvent purging apparatus be developed especially for this type of paint. Such a system is discussed in U.S. Pat. No. 4,019,653, issued Apr. 26, 1977. This system, as with the others previously described, also suffers all of the disadvantages heretofore characterized regarding solvent purging and flushing.

Organic solvents are normally used to clean coating materials from spray apparatus by dissolving, diluting, and displacing it. The organic solvents usually have a lower flash point and are more flammable than the coating materials themselves. Therefore, as already disclosed, the cleaning operation may entail a greater hazard than the coating operation. Furthermore, as already seen, the use of organic solvents for cleaning and flushing spray apparatus can cause the emission of volatile solvents to the atmosphere. In many instances, for example, as earlier described with color changes, air is pulsed into the solvent to promote turbulence in the flow to more effectively remove the coating formulation. In which case, this air is vented to the atmosphere saturated with organic solvent. As already seen, the cleaning operation with organic solvents also creates a large amount of hazardous waste to be disposed of safely.

The general use of compressed fluids as cleaning vehicles are known to those skilled in the art. For example, Whitlock in U.S. Pat. No. 4,806,171, issued Feb. 21, 1989, discloses an apparatus for removing submicron particles from a substrate by projecting a stream containing solid (dry ice snow) and gaseous carbon dioxide, which is produced by expanding liquid carbon dioxide through several chambers and an exit port, toward the substrate whereupon said stream blows across the surface, removing the particles without scratching the substrate. Berg in U.S. Pat. No. 3,947,567, issued Mar. 30, 1976, discloses cleaning compositions exhibiting effervescence, which comprise a cleaning agent and a liquefied gas present in the compositions at pressure and temperatures at which it would normally exist only in the gaseous state, wherein as vapors of the liquefied gas separate from the compositions, effervescence occurs. These cleaning compositions are maintained in an aerosol container and include such cleaning compositions as mouthwash, breath freshener, toothpaste, soaps, shampoos, drain cleaners, sink cleaners, rug cleaners, and the like. A variety of liquified gases are suitable. Typical of such materials are octafluorocyclobutane, chlorodifluoromethane, propane, butane, cyclobutane, pentane, and mixtures thereof. The compositions can also contain dissolved gases together with the liquefied gases such as carbon dioxide, nitrous oxide, and air. The liquefied gases used are those with boiling points ranging from about −50 F. to about 80 F with vapor pressures, at the upper temperature level, typically of around 150 psig.

Another common approach is cleaning by employing supercritical gas in a pressure vessel. An example is Japanese Patent No. 59,502,137, dated Dec. 27, 1984, where contaminants produced during the manufacture and processing of a solid structural component or element are removed from its surface by contact with supercritical gas in a pressure vessel. Preferably the treatment is effected with carbon dioxide at a temperature of 35 C. to 100 C. and a pressure of 1500 to 10000 psi. The contact time may be 0.25 to 4 hours. Material surfaces that may be cleaned include metals, rubber, synthetic polymers, carbon and quartz crystals. Another example is described in Japanese Patent No. 61,177,301, dated Aug. 9, 1986, in which a mixture of heat resistant material powder and binder is preformed and all preformed surfaces are coated with a substance to be removed by heating and lowering the pressure. The preformed coating is then pressure formed in a vessel by high isostatic pressure and successively contacted with supercritical fluids. The heat resistant material may be metal, metal oxide, ceramics, etc. The binder and coating substance may use higher alcohol, fatty acid polyethylene, etc., and the supercritical fluid may be carbon dioxide or fluorohydrocarbon. The isostatic pressure ranges from 1422 to 14223 psi.

The semiconductor industry also utilizes supercritical fluid, especially carbon dioxide, for cleaning. Japanese Patent No. 01,045,131, dated Feb. 17, 1989, teaches the washing and oxidizing of a semiconductive wafer by washing it first with supercritical or liquefied carbon dioxide and then the wafer is contacted with carbon dioxide including at least one kind of substance having oxygen to oxidize the silicon surface of the semiconductive wafer. The washing and oxidizing is performed in one tank, thereby reducing the possible contamination of the wafer by exposure to the atmosphere. Japanese Patent No. 60,192,333, issued Sep. 30, 1985, discloses a method for removing a hardened organic film from the substrate to which it is bonded, and in particular concerns a method which is suitable for mechanically peeling off the coated film of a photoresist coated film on a semiconductor wafer. In this case, the substrate with the hardened bonded organic film is first put under high pressure, mixed with a liquified gas and then brought into contact with a supercritical gas, after which the temperature and pressure conditions are changed to cause the gas to expand, and the hardened organic film is removed from the substrate by this expansion force. The liquid gas or the supercritical gas is dissolved either on the hardened organic film itself or at the interface between the organic film and the substrate. When either the pressure is decreased and/or the temperature is increased, the dissolved gas inside the hardened organic film or in the interface between the film and the substrate expands, resulting in the exfoliation of the hardened organic film from the substrate. The preferred liquified gas or supercritical gas is carbon dioxide, in which case it is desirable to add an organic solvent in which carbon dioxide is highly soluble to improve permeation into the hardened organic film and its substrate.

Another method is disclosed in U.S. Pat. No. 4,238,244, issued Dec. 9, 1980, which uses the technique of raising and lowering pressure to produce gas bubbles for removing inorganic deposits from industrial equipment such as heat exchangers. It is different from the above discussed methods in that it generally circulates the cleaning liquid through the apparatus. The method disclosed is specifically the removal of deposits of corrosion products and scale from the interior surfaces of heat transfer equipment with a liquid composition capable of removing said deposits under appropriate contact conditions of pH, temperature, concentration, and pressure for a period of time sufficient to remove the deposits. The deposits cited to be removed include inorganic materials such as metal oxides, spinels, metal sulfides, and water scale such as gypsum and magnesium oxides and others. The liquid cleaning compositions cited for removing the deposits include inorganic and organic acids, salts of such acids, and inorganic and organic bases. The method generally calls for dissolving at super atmospheric pressure a chemical that is a gas at atmospheric conditions to form a solution that produces a gas when at reduced pressure. The preferred gas is carbon dioxide. The procedure comprises: contacting the deposits with the solution for an initial period of time; contacting the deposits with this solution for an additional period of time at a reduced pressure, wherein carbon dioxide is liberated from the solution and said solution is therein agitated during such said contacting; and repeatedly raising and lowering the pressure exerted on the solution while contacting the deposits such that carbon dioxide is repeatedly placed in solution and liberated therefrom, thereby causing agitation which improves the deposit removal. The super atmospheric pressure mentioned ranges from above atmospheric up to about 1500 psig at temperatures in the range of from atmospheric to about 350 F. (about 177 C.). While it is indicated that various concentrations of the gas-forming substance can be used, it is asserted that concentrations in the range from about 0.1 percent to about 5 percent by weight of deposit-removing liquid has been found to be effective. The deposit-removing liquid that consists of acids, bases, or salts constitute a significant majority of the combined deposit-removing, liquid-gas-forming admixture. Whereas such a method enhances the removal of inorganic deposits and scale, it does not significantly result in a reduction in the use of the deposit removal cleaning solution. In addition, this method practices the fluctuation of temperature and pressure condition repetitiously to provide the improvement cited, which is related to formation of gas bubbles which provide the agitating force. Practicing said method would generally suggest the necessity of utilizing an intricate monitoring, control, and operating process for the method to be effective and practical. Such devices are costly and would add to the overall capital, period, and operating costs. Furthermore, the highly corrosive cleaning solution that consists of acids, bases, or salts employed for removing the inorganic deposits is inappropriate and incompatible with removing organic deposits such as coating formulation and polymers from spray apparatus.

In the methods of the present invention, wherein spray apparatus is purged and cleaned between coating material change or at shut down, organic solvents constitute not only part of the coating formulation but the cleaning solution as well. Since these organic solvents generally are potential pollutants, their containment and waste disposal dictate minimal usage. Such would not be the case if the method discussed in the aforementioned patent was practiced within the constraint implied by the very low range of concentration of the gas-forming substance in the deposit-removing liquid. Moreover, with coating formulations admixed with supercritical fluids such as carbon dioxide as diluents, lowering the pressure to levels below the critical point could result in the formation of two phases plus significant vaporization of carbon dioxide, wherein pockets high in carbon dioxide concentration may form and contact the coating admixture, from which could result undesirable deposition of coating materials on conduit walls and on internal surfaces of the apparatus, which causes deposits that are harder to remove. In fact, under the worse of conditions, highly viscous pure, or nearly pure, polymer could come out of solution, indeed presenting a most difficult and costly removal condition.

Clearly, what is needed is a means for purging, flushing and cleaning apparatus, particularly spray apparatus between color or material changes, and at equipment shutdown that has low organic solvent usage, low cost, low hazard, and minimal environmental impact and that minimizes the creation of hazardous waste. A similar means is needed for purging cleaning solutions from the spray apparatus following the cleaning operation.

Such a means has now been found by the use of supercritical fluids, such as supercritical carbon dioxide or nitrous oxide that are utilized in their supercritical or near-supercritical fluid state which have been discovered to have favorable utility in purging, flushing and cleaning spray apparatus and have also been found to have the above mentioned advantages. They have been further discovered to have favorable utility in purging cleaning solutions from spray apparatus following cleaning.

SUMMARY OF THE INVENTION

A new cleaning mixture and methods of using such cleaning mixtures to clean apparatus, particularly purging, flushing, and cleaning spray apparatus when changing from one material to another material, such as changing material color or composition, and for cleaning the apparatus when spraying is finished or the apparatus is shut down or idled, have now been discovered. In addition, said cleaning mixtures may contain water, organic coupling solvent, and the like, particularly for supercritical fluid spray compositions that contain water.

In its broad aspect, the present invention is directed to a liquid cleaning mixture for removing at least one or more polymeric compounds from an apparatus comprising at least one compressed fluid and at least one active solvent in which said at least one or more polymeric compounds are at least partially soluble and which is at least partially miscible with the at least one compressed fluid, said compressed fluid being a gas at standard conditions of 0° C. and one atmosphere (STP), which cleaning mixture is in one phase and at a pressure at which the cleaning mixture is substantially near its two phase region.

The invention is also directed to a cleaning mixture wherein the pressure is such that the compressed fluid may either be in its subcritical or supercritical states.

In a preferred embodiment, the methods of the present invention utilize supercritical carbon dioxide, nitrous oxide, or a mixture thereof.

As a further embodiment, the invention is also directed to a process as described above in which the cleaning mixture is pressurized to match the pressure at which material is sprayed from the spray apparatus or even to a pressure which is above the pressure at which material is sprayed from the spray apparatus in order to increase solubility of the cleaning mixture.

In an alternative embodiment of the present invention, a cleaning method is disclosed which comprises a method of cleaning apparatus containing one or more polymeric compounds which compries:

a) forming a one phase, liquid cleaning mixture comprising:
   (i) a compressed fluid fraction containing at least one compressed fluid, said compressed fluid being a gas at standard conditions of 0° C. and one atmosphere (STP); and
   (ii) a solvent fraction containing at least one active solvent component in which said at least one or more polymeric compounds are at least partially soluble and which is at least partially miscible with the at least one compressed fluid component; and
b) passing said liquid cleaning mixture through the apparatus at a pressure at which the cleaning mixture and the polymer dissolved therein is substantially near its two phase boundary region.

As a preferred embodiment, the amount of solvent fraction is present in at least an amount such that the liquid cleaning mixture is capable of at least partially dissolving and/or suspending the one or more polymeric compounds.

As a minimum, the pressure in the apparatus is maintained at the vapor pressure of the compressed fluid at ambient temprature. Preferably, the pressure is at least at the critical pressure for the compressed fluid and is no greater than about 5000 psi. More preferably, the pressure is in the range of from about 1500 to about 3000 psi. When the compressed fluid is carbon dioxide, the pressure is generally in the range of from about 800 to about 5000 psi, preferably in the range of from about 1070 to about 4000 psi, and most preferably in the range of from about 1500 to about 3000 psi.

Generally, the amount of solvent fraction in the mixture is in the range of from about 5 to about 70% by weight based on the weight of the total liquid cleaning mixture, and preferably it is in the range of from about 10 to about 50% by weight on the same basis.

As a further embodiment, the present invention is directed to a method for cleaning spray apparatus in which a liquid composition comprised of at least one or more polymeric compounds, one or more organic solvents in which the polymeric compounds are at least partially soluble, and at least one compressed fluid is sprayed at a pressure $P_1$ comprising:

a) forming a one phase, liquid cleaning mixture comprising:
   (i) a compressed fluid fraction containing at least one compressed fluid, said compressed fluid being a gas at standard conditions of 0° C. and one atmosphere (STP); and
   (ii) a solvent fraction containing at least one active solvent component in which said at least one or more polymeric compounds are at least partially soluble and which is at least partially miscible with the at least one compressed fluid component; and
b) passing said liquid cleaning mixture through the apparatus at a pressure $P_2$, where $P_2$ is greater than $P_1$.

Also as preferred embodiments, the cleaning mixture is heated, desirably to match the temperature at which material is sprayed from the spray apparatus and/or heated just prior to exiting the spray apparatus in order to prevent adverse effect caused by rapid cooling when it is vented from the spray apparatus.

The invention is also directed to a process as described above in which the cleaning mixture contains a lower proportion of organic solvent component at the end of the cleaning cycle than at the beginning so as to further diminish the use of organic solvents and the creation of hazardous waste.

In alternative embodiments, the invention is also directed to a process as described above to which surfactants, detergents, antifoaming agents, wetting agents, abrasives, and other cleaning additives well known in the art are added to the cleaning mixture of (a) and (b).

By virtue of using low cost non-polluting carbon dioxide or nitrous oxide to replace a plurality of the organic solvent used, the method of this instant invention provides an improved color change method, which accomplishes the color change and cleaning function, wherein the structure of the system is relatively simple, economical, and environmentally attractive.

The foregoing and other objectives, advantages and features of the invention will become apparent upon a consideration of the following detailed description.

DETAILED DESCRIPTION OF THE INVENTION

Figure 1:
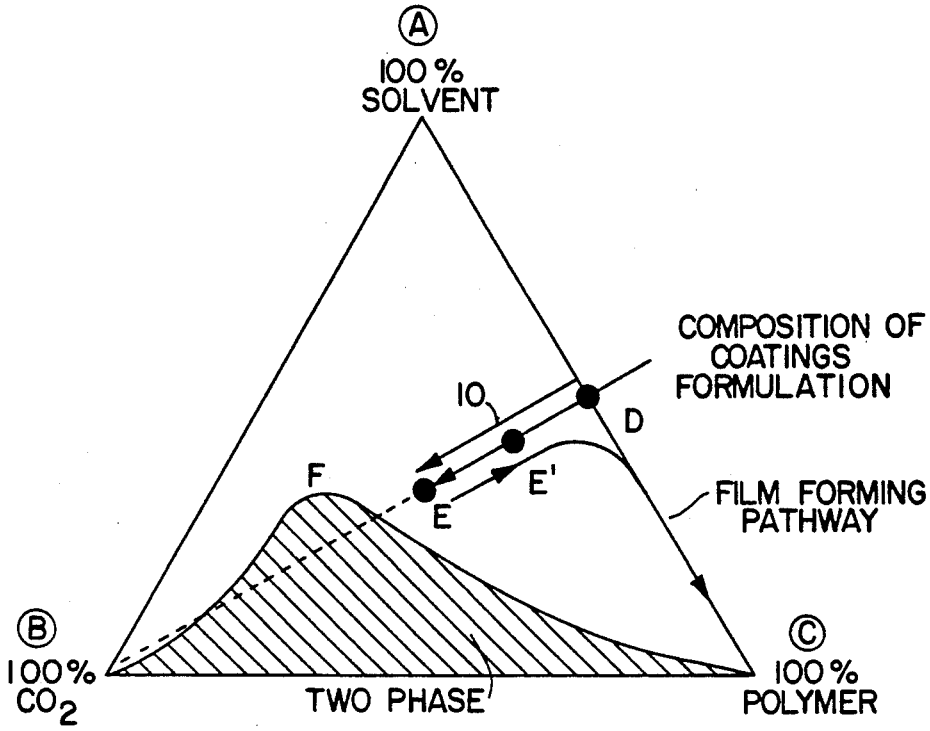
FIG. 1 is a phase diagram of a supercritical carbon dioxide fluid spray applied coating.

It has been discovered that by using the methods of the present invention, coating material changes, including color change, and final cleaning of the coating apparatus can be accomplished in industrial applications wherein a variety of coatings are applied to a variety of substrates in a manner that offers a reduced environmental threat and is highly cost effective. Consequently, the use of organic solvents can be greatly reduced when utilizing compress fluids, such as supercritical carbon dioxide or nitrous oxide, as a fluid for purging, flushing, and cleaning coating compositions from equipment, wherein complete solubility is retained, or in conjunction with other solvents when required for solubility constraints; and, the use of compressed fluids, such as carbon dioxide or nitrous oxide, for coating compositions wherein carbon dioxide or nitrous oxide, for example, is not a satisfactory solvent under ambient conditions or below its critical point, but becomes a said solvent either by itself or when mixed with other solvents and subjected to temperatures and pressures that position the system slightly below, at, or above the critical state of the supercritical fluid.

As used herein, it will be understood that a "supercritical fluid" is a material which is at a temperature and pressure such that it is at, above, or slightly below its "critical point". As used herein, the "critical point" is the transition point at which the liquid and gaseous states of a substance merge into each other and represents the combination of the critical temperature and critical pressure for a given substance. The "critical temperature", as used herein, is defined as the temperature above which a gas cannot be liquified by an increase in pressure. The "critical pressure", as used herein, is defined as that pressure which is just sufficient to cause the appearance of two phases at the critical temperature.

Also as used herein, it will be understood that a "subcritical fluid" is a material which is at a temperature and/or pressure such that it is below its critical point. Such a subcritical fluid may be (i) below its critical temperature while being above its critical pressure, or (ii) below its critical pressure while being above its critical temperature, or (iii) below both its critical temperature and critical pressure.

Finally, as also used herein, a "compressed fluid" is mean to include either a supercritical fluid or a subcritical fluid and is a material which is a gas at standard conditions of 0° C. and one atmosphere (STP). The compressed fluid may be in its gaseous state, its liquid state, or a combination thereof depending upon the particular temperature and pressure to which it is subjected upon addition to the apparatus to be cleaned and its vapor pressure at that particular temperature.

Generally, the polymeric components which the cleaning mixture of the present invention will be able to dissolve and/or suspend so as to remove them from an apparatus include vinyl, acrylic, styrenic, and interpolymers of the base vinyl, acrylic, and styrenic monomers; polyesters, oil-free alkyds, alkyds, and the like; polyurethanes, two-package polyurethane, oil-modified polyurethanes and thermoplastic urethanes systems; epoxy systems; phenolic systems; cellulosic esters such as acetate butyrate, acetate propionate, and nitrocellulose; amino resins such as urea formaldehyde, melamine formaldehyde, and other aminoplast polymers and resins materials; natural gums and resins; rubber-based adhesives including nitrile rubbers which are copolymers of unsaturated nitriles with dienes, styrene-butadiene rubbers, thermoplastic rubbers, neoprene or polychloroprene rubbers, and the like.

The solvent fraction which is mixed with the compressed fluid fraction to form the liquid cleaning mixture of the present invention is comprised of essentially any active organic solvent and/or non-aqueous diluent which is at least partially miscible with the polymeric compounds so as to form either a solution, dispersion, or suspension. As used herein, an "active solvent" is a solvent in which the polymeric compounds are at least partially soluble. The selection of a particular solvent fraction for a given polymeric compound in order to dissolve and/or suspend such polymer for a given set of conditions is conventional and well known to those skilled in the art. Moreover, up to about 50% by weight of water, preferably up to about 30% by weight, may also be present in the solvent fraction provided that a coupling solvent is also present in the formulation. All such solvent fractions are suitable in the present invention.

A coupling solvent is a solvent in which the polymeric compounds used is at least partially soluble. Most importantly, however, such a coupling solvent is also at least partially miscible with water. Thus, the coupling solvent enables the miscibility of the polymeric compounds, the solvent fraction and the water to the extent that a single phase is desirably maintained.

Coupling solvents are well known to those skilled in the art and any conventional coupling solvents which are able to meet the aforementioned characteristics, namely, those in which the polymeric components are at least partially soluble and in which water is at least partially miscible are all suitable for being used in the present invention.

Applicable coupling solvents which may be used in the present invention include, but are not limited to, ethylene glycol ethers; propylene glycol ethers; chemical and physical combinations thereof; lactams; cyclic ureas; and the like.

Specific coupling solvents (which are listed in order of most effectiveness to least effectiveness) include butoxy ethanol, propoxy ethanol, hexoxy ethanol, isopropoxy 2-propanol, butoxy 2-propanol, propoxy 2-propanol, tertiary butoxy 2-propanol, ethoxy ethanol, butoxy ethoxy ethanol, propoxy ethoxy ethanol, hexoxy ethoxy ethanol, methoxy ethanol, methoxy 2-propanol, and ethoxy ethoxy ethanol. Also included are lactams such as n-methyl-2-pyrrolidone, and cyclic ureas such as dimethyl ethylene urea.

When water is not present in the cleaning mixture, a coupling solvent is not necessary, but may still be employed. Other solvents, particularly active solvents, which may be present in the cleaning mixtures of the present invention include ketones such as acetone, methyl ethyl ketone, methyl isobutyl ketone, mesityl oxide, methyl amyl ketone, cyclohexanone and other aliphatic ketones; esters such as methyl acetate, ethyl acetate, alkyl carboxylic esters; ethers, such as methyl t-butyl ether, dibutyl ether, methyl phenyl ether and other aliphatic or alkyl aromatic ethers; glycol ethers such as ethoxy ethanol, butoxy ethanol, ethoxy 2-propanol, propoxy ethanol, butoxy 2-propanol and other glycol ethers; glycol ether esters such as butoxy ethoxy acetate, ethyl 3-ethoxy propionate and other glycol ether esters; alcohols such as methanol, ethanol, propanol, iso-propanol, butanol, iso-butanol, amyl alcohol and other aliphatic alcohols; aromatic hydrocarbons such as toluene, xylene, and other aromatics or mixtures of aromatic solvents; aliphatic hydrocarbons such as VM&P naphtha and mineral spirits, and other aliphatics or mixtures of aliphatics; nitro alkanes such as 2-nitropropane. A review of the structural relationships important to the choice of solvent or solvent blend is given by Dileep et al., *Ind. Eng. Chem.* (Product Research and Development) 24, 162, 1985 and Francis, A.W., *J. Phys. Chem.* 58, 1099, 1954.

Of course, there are solvents which can function both as coupling solvents as well as active solvents and the one solvent may be used to accomplish both purposes. Such solvents include, for example, butoxy ethanol, propoxy ethanol and propoxy 2-propanol. Glycol ethers are particularly preferred.

Examples of compounds that may be utilized as compressed fluids in the present invention, include but are not limited to, carbon dioxide, nitrous oxide, ammonia, xenon, ethane, propane, chlorotrifluoromethane, monofluoromethane, and the like.

Preferably, the compressed fluid has a critical temperature above the ambient temperature of the spray environment and has appreciable solubility with the polymeric compound.

Moreover, the compressed fluid is preferably environmentally compatible, can be made environmentally compatible by treatment, or can be readily recovered from the spray environment. For example, carbon dioxide is environmentally compatible. Nitrous oxide can be made environmentally compatible by natural decomposition in the environment, or by heating to thermally decompose it, to form molecular nitrogen and oxygen. Ethane and propane can be made environmentally compatible by incineration to carbon dioxide and water. Ammonia is highly soluble in water and can be removed and recovered from air streams by absorption methods such as an air/water scrubber. Other methods can also be used such as adsorption.

The utility of any of the above-mentioned compounds as compressed fluids for used in the cleaning mixtures in the practice of the present invention will depend upon the polymeric compound(s) and the specific solvent fraction used taking into account the temperature and pressure of application and the inertness of the subcritical compressed fluid with the remaining constituents of the composition contained in the apparatus which is to be cleaned.

Due to their environmental compatibility, low toxicity, non-flammability, favorable physical properties at ambient temperature, and high solubility in coating compositions, compressed carbon dioxide and nitrous oxide are preferably used in the practice of the present invention. Due to its low cost and wide availability, compressed carbon dioxide is most preferred. However, use of any of the aforementioned compounds and mixtures thereof are to be considered within the scope of the present invention. For example, mixtures of compressed carbon dioxide and nitrous oxide may be useful because nitrous oxide is more polar than carbon dioxide and has different solvent properties. Compressed ammonia has still higher polarity and even relatively small amounts in combination with nitrous oxide may be useful to obtain higher solubility in some coating compositions. Compressed ammonia tends to react with ritical compressed carbon dioxide, but this may be useful with some coating compositions.

Because of its relevancy to the present invention, a brief discussion of the supercritical fluid state is warranted. Supercritical fluid phenomenon is well documented, see pages F-62 to F-64 of the CRC Handbook of Chemistry and Physics, 67th Edition, 1986–1987, published by the CRC Press, Inc., Boca Raton, Fla. At high pressures above the critical point, the resulting supercritical fluid, or "dense gas", will attain densities approaching those of a liquid. These properties are dependent upon the fluid composition, temperature, and pressure.

The compressibility of supercritical fluids is great just above the critical temperature where small changes in pressure result in large changes in the density of the supercritical fluid. The "liquid-like" behavior of a supercritical fluid at higher pressures results in greatly enhanced solubilizing capabilities compared to those of the subcritical compound, with higher diffusion coefficients and an extended useful temperature range compared to liquids. Organic compounds of high molecular weight can often be dissolved in the supercritical fluid at relatively low temperatures. An interesting phenomenon associated with supercritical fluids is the occurrence of a threshold pressure for solubility of a high molecular weight solute. As the pressure is increased, the solubility of the solute will often increase by orders of magnitude with only a small pressure increase.

Near-supercritical liquids also demonstrate solubility characteristics and other pertinent properties similar to those of supercritical fluids. The solute may be a liquid at the supercritical temperatures, even though it is a solid at lower temperatures. In addition, it has been demonstrated that fluid "modifiers" can often alter supercritical fluid properties significantly, even in relatively low concentration, greatly increasing solubility for some solutes. These variations are considered to be within the concept of a supercritical fluid as used in the context of this invention. Therefore, as used herein, the phrase "supercritical fluid" denotes a compound above, at, or slightly below the critical temperature and pressure (the critical point) of that compound. Examples of compressed gases that are known to have utility as supercritical fluids include: carbon dioxide, ammonia, nitrous oxide, xenon, krypton, methane, ethane, ethylene, propane, chlorotrifluoromethane, monofluoromethane, and the like.

The solvency of supercritical carbon dioxide can sometimes be considered similar to that of a lower aliphatic hydrocarbon such as hexane or heptane. Therefore, as taught in the aforementioned related patent applications, in the liquid spray application of coatings one can consider supercritical carbon dioxide as having solubility characteristics similar to the hydrocarbon diluent portion of a conventional coating formulation. However, this is an inadquate analogy, because in some polymer systems it is several times more soluble than hydrocarbon diluents like heptane. Furthermore, its solvency is a function of pressure, so the solubility phase diagram has another degree of freedom. Solubility generally increases with higher pressure and decreases with higher temperature. Although supercritical carbon dioxide behaves as a diluent solvent, it replaces most of the highly volatile solvents in a coating formulation, diluent and active solvents alike. These solvents evaporate in the spray or shortly after application, so they do not contribute much to film coalescence and leveling like the less volatile solvents that are kept in the reformulated coating. Due to the solvency of the supercritical carbon dioxide in coating formulations, a single-phase liquid mixture is formed that is sprayed by airless spray techniques. In addition to the environmental benefit of replacing organic solvents, there is also a safety benefit because carbon dioxide is nonflammable.

The coatings, adhesives, mold release agents, lubricants, detergents, insulation, herbicides, foamed plastics, fuels, pesticides, microspheres, microballoons, spray-dried materials, structural and reinforced plastics, coverings, and the other materials previously discussed are commonly sprayed by passing the material under pressure through an orifice into air in order to form a liquid spray. In industry, three types of orifice sprays are commonly used; namely, air spray, airless spray, and air-assisted airless spray. For the purposes of the present invention, the air spray method and apparatus are of lesser importance; under certain conditions, namely, upgrading the equipment to withstand the pressures involved, however, this technique would be inclusive when applying said invention.

Airless spray uses a high pressure drop across the orifice to propel the material through the orifice at high velocity. Upon exiting the orifice, the high-velocity liquid breaks up into droplets and disperses into the air to form a liquid spray. When deposition is desired, residual momentum carries the spray droplets to the substrate. Spraying pressures range from low pressure to pressures up to 5000 psig or higher, depending upon the viscosity and other characteristics of the material. Generally higher viscosity requires higher spraying pressure. For the application of coatings, pressures typically range from 500 to 3000 psig, although higher and lower pressures are also used.

Air-assisted airless spray uses both compressed air and high pressure drop across the orifice to atomize the material, typically under milder conditions. Liquid spray pressures typically range from 200 to 800 psig, but spraying is also done at lower and higher pressures, near and above the supercritical pressure for carbon dioxide.

In essentially every process in which a mixture is prepared for a particular purpose, the constituents of that mixture usually need to be present in particular, proportionated amounts in order for the mixture to be effective for its intended use. In the aforementioned related patents and applications, the underlying objective is to reduce the amount of organic solvent present in a coating formulation, adhesive, mold release agent, or other material or composition by the use of supercritical fluid. Understandably, with this objective in mind, it is generally desirable to utilize as much supercritical fluid as possible while still retaining the ability to effectively spray the mixture containing the material and the supercritical fluid and also obtain a desirable product, whether it is the application of a coating, adhesive, or mold release agent to a substrate or some other result. Accordingly, here too, it is preferred that the mixture contain prescribed proportionated amounts.

For the spray application of coatings, generally the preferred upper limit of addition of supercritical fluid as a diluent is that which is capable of being miscible with the coating formulation, namely, the solubility limit. The coating formulation contains the polymers and other materials that form the continuous portion of the coating predissolved in suitable organic solvents, but at much higher concentration than conventional coating formulations because much less organic solvent is used. Any insoluble materials such as pigments, metallic flakes, fillers, and the like, which form the discontinuous portion of the coating, are dispersed in the continuous portion. When insoluble materials are not present, the solubility limit in the coating is generally recognizable when the admixture of coating formulation and supercritical fluid breaks down from one phase into two phases as supercritical fluid is added. Excess supercritical fluid beyond the solubility limit generally provides less than optimum coating performance.

To better understand solubility phenomenon, reference is made to the phase diagram in FIG. 1, wherein the supercritical fluid is supercritical carbon dioxide. The vertices of the triangular diagram represent the pure components of an admixture of coating formulation and supercritical carbon dioxide, which for the purpose of this discussion contains no water. Vertex A is organic solvent, vertex B is supercritical carbon dioxide, and vertex C is polymeric material. The curved line BFC represents the phase boundary between one phase and two phases. It can be clearly seen that the organic solvent and the polymer are miscible in all proportions (line AC). Likewise, the organic solvent and the supercritical carbon dioxide are miscible in all proportions (line AB). In this example, which is typical of the majority of the coating formulations found useful in the application of the present invention, the polymer and the supercritical carbon dioxide are immiscible (line BC). The point D represents a possible composition of a coating formulation in which supercritical carbon dioxide has not been added. The point E represents a possible composition of an admixed coating formulation, after admixture with supercritical carbon dioxide. Thus, after atomization, a majority of the carbon dioxide vaporizes, leaving substantially the composition of the original coating formulation. Upon contacting the substrate, the remaining liquid mixture of the polymer and solvent components will flow, that is, coalesce, to produce a uniform, smooth film on the substrate. The film forming pathway is illustrated in FIG. 1 by the line segments EE'D (atomization and decompression) and DC (coalescence and film formation).

Importantly, the amount of supercritical fluid, such as supercritical carbon dioxide, that can be mixed with a coating formulation while avoiding developing two phases is generally a function of the miscibility of the supercritical fluid with the coating formulation as can best be visualized by referring to FIG. 1. As can be seen from the phase diagram, particularly as shown by arrow 10, as more and more supercritical carbon dioxide is added to the coating formulation, as represented by point D, the composition of the admixed liquid coating mixture approaches the two-phase boundary represented by line BFC. If enough supercritical carbon dioxide is added, the two-phase region is reached and the composition correspondingly breaks down into two fluid phases. Although it may sometimes be desirable, generally it is not preferable to go much beyond this two-phase boundary for optimum spraying performance or coating formation because nonhomogeneity of the spray admixture may cause unsuitable atomization and consequently imperfect coating of the substrate.

In order to spray on demand admixed liquid coating formulations containing supercritical fluid as a diluent on a continuous, semi-continuous, intermittent, or periodic basis, it is necessary to prepare the admixture in response to such spraying by accurately mixing a proportioned amount of the coating formulation with the supercritical fluid. However, the compressibility of supercritical fluids is much greater than that of liquids; consequently, a small change in pressure or temperature results in large changes in the density of the supercritical fluid. Even at ambient temperature, carbon dioxide is relatively compressible, which distinguishes it from most fluids. Therefore, much attention must be given to the accurate proportionation of the compressible carbon dioxide and non-compressible coating formulation to provide the proper admixture for spray application.

Figure 2:
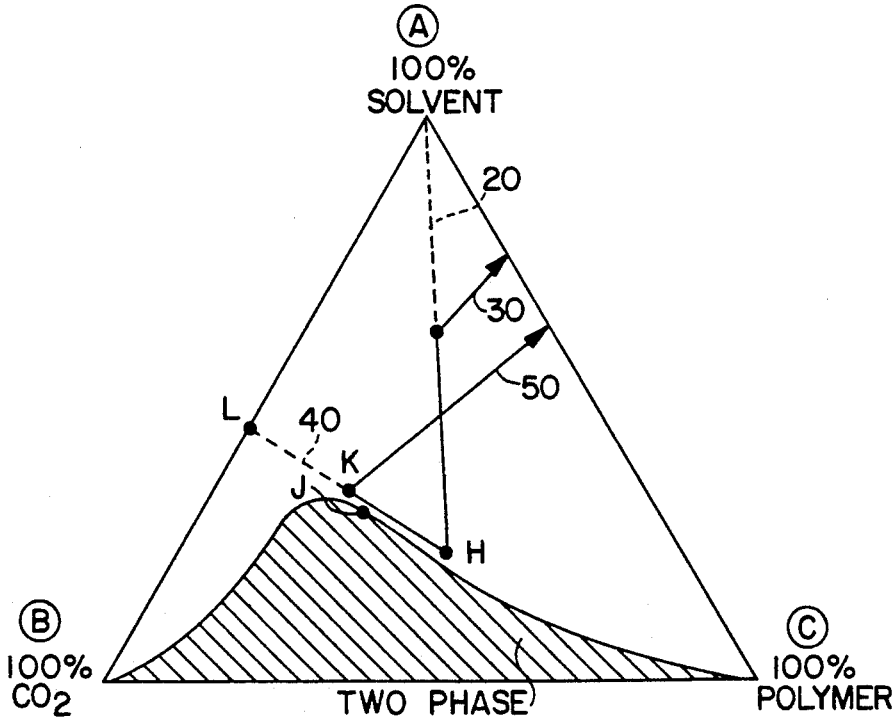
FIG. 2 is another phase diagram of a supercritical carbon dioxide fluid spray applied coating illustrating the addition of solvent and/or diluent.

To understand the relevant phenomena occurring when a cleaning solution or a mixture containing two components, namely organic solvent and carbon dioxide, is added to a spray composition containing three components, namely polymer, organic solvent, and carbon dioxide, a phase diagram of a typical supercritical carbon dioxide spray applied coating system is presented in FIG. 2. In this Figure, the vertices of the triangular diagram represent the pure components of the coating formulation admixture. Vertex A is the active solvent used both in the coating system and for purging, flushing and cleaning, vertex B is supercritical carbon dioxide, and vertex C the polymeric material. The curved line BJC represents the phase boundary between one phase and two phases. As can be seen in this illustration, the polymer and solvent are miscible in all portions, the solvent and supercritical carbon dioxide are also miscible in all portions, but the polymer and the supercritical carbon dioxide are not miscible in any portion; however, in some instances partial miscibility may occur near the vertices.

The point H represents a possible composition of the coating formulation after the addition of carbon dioxide fluid and the supercritical state is effected. The position of point H shows it to be near the two phase envelope. This is environmentally desirable because such a preferred position allows the maximum use of carbon dioxide as a diluent and permits some operating latitude, yet also provides for the effective spraying of the liquid admixture. It is clearly evident that the addition of much more carbon dioxide could result in the undesirable formation of two phases.

The composition and film forming pathways, which occur under diluting and spraying operations, have been aforementioned when the phenomena illustrated in FIG. 1 was presented; point H is equivalent to the point E represented in FIG. 1. When pure solvent is added to admixture H, the composition of the system changes as more solvent is added. Said changing composition is represented as the locus of points along line 20, as formed between point H and vertex A. Point I on line 20, in this example, represents the three-component-mixture composition when a mass of pure solvent equal to the mass of the precursor coating-carbon dioxide admixture is added. At this point, if carbon dioxide is allowed to vaporize, the compositional pathway of the admixed fluid is shown by arrow 30, which case assumes no solvent has vaporized. It can clearly be seen that the composition of the admixed liquid at line A-C is very rich in solvent, in this instance about 75 percent solvent; about a threefold increase over the initial content in the coating formulation admixture.

The preferred case, however, is where a purging, flushing and cleaning solution, which is as rich in carbon dioxide as possible while not causing the compositional system to enter the two phase region, is employed. Lines drawn from point H towards line A-B represent the possible pathways of solutions containing carbon dioxide and solvent.

The point at which one of these lines is tangent to the two-phase boundary curve represents the solution mixture that contains the maximum concentration of carbon dioxide while not causing the wholly admixed system to penetrate into the two phase region. Point J in FIG. 2 illustrates this point. A carbon dioxide-solvent solution just leaner than same is the preferred method of the present invention. For example, such a composition is a locus of points along the line shown as line 40. Point L on line A-B represents this carbon dioxide-solvent composition, which in the present example is about 55 percent carbon dioxide.

Relative to the example wherein pure solvent is used for purging, flushing, and cleaning, the present instance provides a 32 percent reduction in the amount of organic solvent used in this operation. Environmentally, this is a very desirable outcome, which clearly also offers lower cost advantages because carbon dioxide is less expensive than the solvents customarily used, and waste disposal requirements are also markedly reduced.

Point K on line 40 represents the composition of an admixture when a mass of the shown carbon dioxide-solvent solution equal to the mass of the precursor coating admixture H is added. Should the carbon dioxide then be allowed to vaporize without any solvent loss, the compositional pathway is represented by arrow 50. The solvent content of the polymer-solvent mixture represented in the illustration when all of the carbon dioxide has vaporized is about 60 percent; clearly much leaner in solvent than in the pure solvent example.

The same magnitude of improvement occurs when comparing the methods of the present invention to the method taught by Banks in U.S. Pat. No. 4,238,244, wherein the preferred carbon dioxide-deposit-removing liquid solution contains only about 0.1 percent to about 5 percent carbon dioxide by weight of carbon dioxide. Since a line drawn from point H to points within this range of compositions on line AB would be only slightly displaced to the left of line 20, it can be clearly seen by referring to FIG. 2 that practice of the latter would not yield much of an improvement over using pure solvent, which is the worst case, for purging, flushing and cleaning between coating material change and/or final cleanup of the spray coating apparatus, and certainly not even closely approaching the advantages depicted by line 40.

Yet another possible case can be illustrated, wherein, when it is viable before purging, flushing, and cleaning, to increase the pressure in the spray coating apparatus beyond the optimum pressure utilized during the spray coating application, a means of operation becomes feasible in which a further reduction in the amount of solvent used during said purging, flushing, and cleaning operation can be gained. For example, in the spray application of coatings wherein supercritical carbon dioxide is used, the spray pressure is determined by the spray requirements and could be relatively low, such as about 1050 psi to about 1200 psi. When a higher pressure is used for cleaning than spraying, such as, for example, about 1600 psi to about 2000 psi, less organic solvent is needed for cleaning because of the greater miscibility of the carbon dioxide with the coating formulation at the higher pressures. Alternating between the two pressure levels is relatively easily and inexpensively achieved with conventional apparatus and methods.

Figure 3:
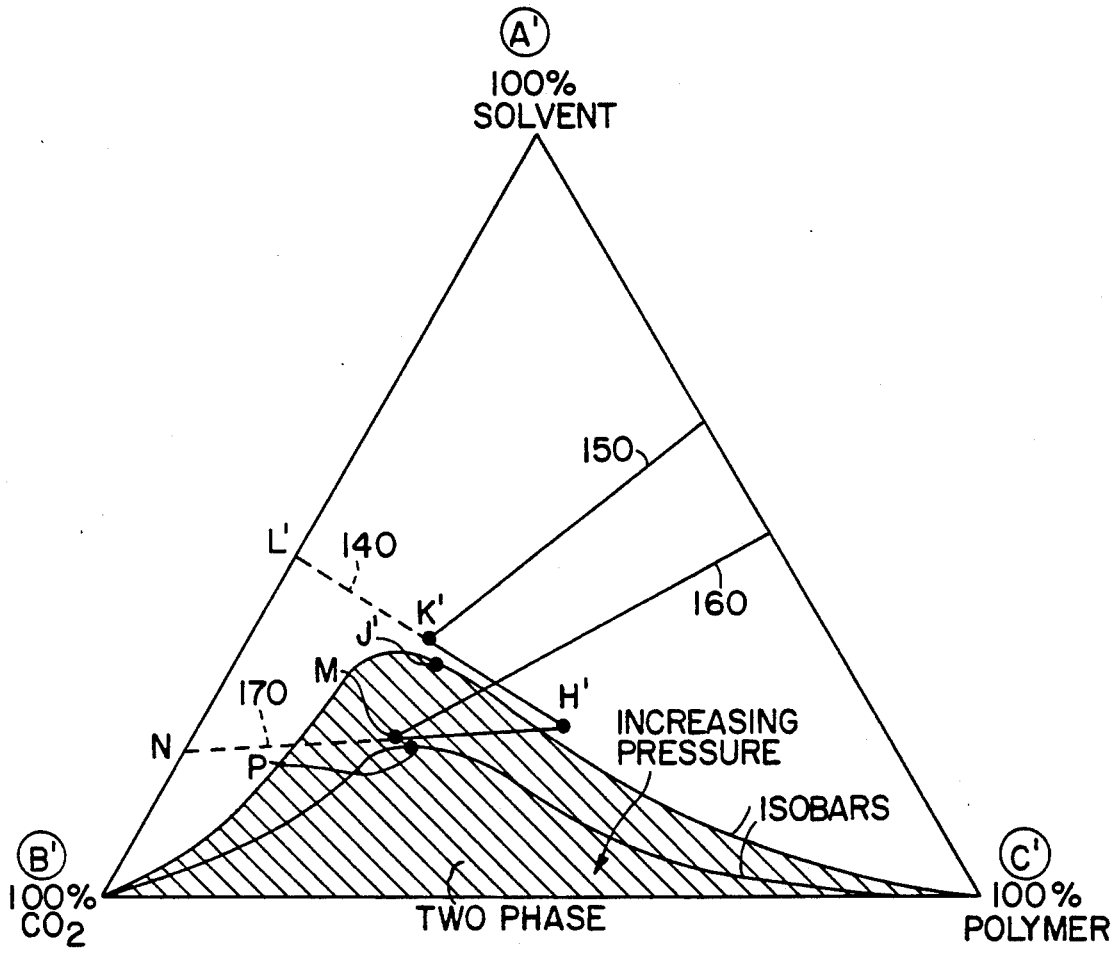
FIG. 3 is a phase diagram of a typical polymer-solvent-carbon dioxide system that illustrates the effect of pressure upon the phase equilibria of said system.

As such a case, FIG. 3 shows an additional two-phase-region envelope delineated by line B'-P-C' within the two-phase-region delineated by line B'-J'-C', of which the latter is identical to line B-J-C as shown in FIG. 2. These two lines illustrate isobars with line B'-P-C' representing the higher pressure isobar. In the Figure, points H', K', L' line 140, and pathway arrow 150 are identical to those described respectively in FIG. 2 as H, K, L, 40, and 50. For the same case previously described with reference to FIG. 2, when spraying with a composition depicted by point H', purging, flushing, and cleaning may be effected by adding a mass of solvent-carbon dioxide admixture of a composition shown as point L' to the mass of coating composition of H', thereby reaching the composition at K', followed by vaporization of carbon dioxide following along the pathway shown as arrow 150 until reaching the A'-C' axis. In the present case, at the beginning of the purging operation, the pressure within the spray coating apparatus is increased such that the two-phase-region now within the envelope represented by the equilibrium line B'-P-C' becomes the relevant phase equilibrium state. Now, considering the composition at point H' in FIG. 3, it is clearly seen that a solvent-carbon dioxide admixture much leaner in volatile organic solvent can be used in the purging, flushing, and cleaning operation. Such an admixture is shown as point N, and in the present case is about 80 percent carbon dioxide. When a mass of such a composition equal to the mass of the original coating mixture is added to the coating mixture, the composition moves along line 170 until point M is reached, at this point it may also be clearly seen that the undesirable penetration into the two-phase-region is avoided. When the composition now at M is vaporized, assuming no evaporation of solvent, the process follows the pathway represented by arrow 160 until reaching the A'-C' axis, at which point there is a relatively solvent-lean coating composition of about 48 per cent solvent, versus about 60 per cent for the prior case. Therefore, the improvement when using this mode (representing using a 20/80 solvent-carbon dioxide mixture) results in about a 78 percent reduction in the solvent used for purging, flushing, and cleaning relative to that used in the prior example when the L' solvent-carbon dioxide 35/65 ratio was utilized.

In a similar manner, because of changes in the equilibrium diagram with temperature, changing the temperature between spraying and purging, flushing, and cleaning can decrease the amount of organic solvent required for the cleaning operation; although, unlike the case for pressure, changing the temperature cannot be done as easily or quickly. The miscibility of carbon dioxide, for example, with coating formulations, increases with decreasing temperature. Should the spraying operation be carried out at say about 50° C. to about 70° C., then lowering the temperature in the spraying apparatus to about 30° C. to about 40° C. before cleaning, and maintaining it within this range, allows a lower concentration of volatile organic solvent in the cleaning solution.

The application of the present invention for purging, flushing, and cleaning conduits and apparatus for coating material change, and/or final cleanup, is generally restricted to airless or air-assisted airless spray coating because of the pressure requirements dictated by the critical pressure of the supercritical fluid used; pressures ranging up to about 5000 psig may be encountered, more likely pressures in the range of about 800 to about 3000 psig are more normally encountered with conventional airless spraying apparatus and coating formulations. When carbon dioxide is the supercritical fluid, only a pressure in excess of its critical pressure of 1057.4 psig is required, but higher pressures may be more beneficial and most likely used.

Any apparatus, however, wherein its maximum allowable working pressure is at or above the maximum pressure encountered during purging, flushing, and cleaning can practice this method, including air spray coating methods and apparatus when vessels, conduits, hoses, pumps, spray guns, and the like have been so upgraded to the higher pressure that would be experienced. In fact, in cases where liquid carbon dioxide or liquid nitrous oxide is compatible and preferably miscible with the coating system being sprayed, no pressure upgrading may be necessary when the apparatus used is rated above the autogenous pressure of the carbon dioxide or nitrous oxide being supplied. Of course, when compatible with the system in use, gaseous carbon dioxide or gaseous nitrous oxide may be employed.

The method of the present invention can be used with, or by modification to, current state-of-the-art methods and apparatus; from the simplest to the most sophisticated automated color change systems. Which in the latter case, may include a circulating paint manifold wherein all passive and active colors are circulating, a remote color selector, and a menu-driven microprocessor sequence controller.

Prior to the present invention, in the common use of the system previously discussed in U.S. Pat. No. 4,265,858, when a coating material change is to be made, purging of the active coating material being sprayed must first be achieved. This is accomplished by a sequencing of valves and other apparatus in a predetermined manner to deactivate the flow of coating material, then activate the flow of a mixture of compressed air and solvent to the solvent aspirator and thence through the common elements of the manifold and other apparatus to a dump valve; however, some flushing of the gun is required. Flow of this mixture of solvent and compressed air continues until the system is purged of the first coating material, at which time this stream and the dump valve are deactivated and the second color coating material is admitted into the clean manifold, and so on and so forth until the apparatus has sequenced through all of the preprogrammed color changes.

Adaptation of this concept to the practice of the method of the present invention is relatively uncomplicated. The compressed air supply to the solvent aspirator is abandoned and replaced with a supply of liquid carbon dioxide, or any other supercritical fluid, which if it is necessary to provide compatibility with the coating material is provided in its supercritical state, because the undesirable penetration into the two-phase region, with the possible precipitation of polymer onto the apparatus, should be avoided. Without any change, perhaps for the exception where the solvent pump and system require upgrading for use at a higher pressure, the present solvent system remains intact as does the valving, pumps, conduits, microprocessor, and the like. In operation, sequencing is carried out as before. The only significant change, therefore, is the use of a carbon dioxide-rich carbon dioxide-solvent mixture for flushing and cleaning rather than the compressed-air solvent mixture. The improvement achieved is the elimination of hazards associated with the employment of a combustible solvent-air mixture, and the benefit provided by retention of more solvent in the system; that is, less loss of the potentially polluting volatile organic solvent to the environment, since vaporization of carbon dioxide rapidly reduces the temperature of the residual solvent mixture by cooling due to the evaporative cooling phenomena associated with depressurizing pressurized liquified gaseous fluids, such that the vapor pressure over said mixture is thereby reduced accompanied by diminishing the amount of vaporization of said volatile organic solvent. This conservation of solvent not only contributes to the benefits received from lowering the environmental impact of operating such apparatus, but it also reduces costs. In particular, significantly less hazardous waste is produced.

When using this or other apparatus wherein the prevalent method of purging and flushing for color change uses only solvent, the improvement gained from practicing the method of the present invention is obvious: the replacement of organic solvent with a mixture of carbon dioxide and solvent. This improvement can be effected using the apparatus cited before—in operation, carbon dioxide and solvent are conveyed to the solvent aspirator, which is easily included in the apparatus should one not previously exist. Or, should it be preferred, off-line apparatus, using ordinary equipment known to those skilled in the art, can be assembled to provide the admixing of carbon dioxide and solvent, then regulating the admixture's temperature and pressure to the preferred level, and finally supplying said admixture to the apparatus wherein its activation occurs by the sequencing devices aforementioned. When using the off-line process, the solvent aspirator apparatus may be eliminated. Previously stated benefits of a reduction in costs and environmental impact arise by replacing organic solvent with nonhazardous, non-polluting carbon dioxide.

An embodiment in the practice of the present invention is the sequential use of one or more additional carbon dioxide-solvent admixtures, wherein the concentration of carbon dioxide is markedly increased in each instance as the sequence progresses. This is possible because less polymer remains in the system, so the concentration is lower and the system is further removed from the two-phase region, which is desirable to avoid precipitation of polymer onto the apparatus. In this manner, lesser amounts of solvent usage is possible resulting in further benefits. All that is needed to practice this embodiment is the inclusion of additional sources of different carbon dioxide-solvent admixtures and the essential valves, programers, controllers, all of which are state-of-the-art equipment. In operation, sequencing of the flow from each of the separate sources is functionally controlled by a sequence controller. Should the method wherein the carbon dioxide and solvent are admixed in an solvent aspirator be preferred, then only the ratio of carbon dioxide to solvent needs to be changed periodically to effect the desired result. This too can be accomplished by using state-of-the-art equipment, with control being supplied by a sequence controller.

Another benefit that may be realized with the method of the present invention is derived from the phenomena of flashing flow associated with the flow of a liquid which is, or becomes, saturated. Without wishing to be bound by theory, whenever the pressure decreases due to flow friction loss caused by the flow of the liquid through a conduit or apparatus, and/or due to pressure decreases due to expansion and contraction in said apparatus, the saturation temperature decreases because of the pressure decrease, and a portion of said liquid is vaporized to maintain thermodynamic equilibrium. Thus localized two-phase flow occurs, with the ratio of the two phases continuously changing as flow proceeds through the apparatus. Several types of flow are possible; however, in this case, vapor is being produced throughout the liquid, which probably tends to produce bubble flow in which the gas is dispersed as fine bubbles throughout the liquid. without coalescence, which should not occur, no localized concentration of the gas would occur, and the coating material-carbon dioxide-solvent admixture would not necessarily enter the liquid two-phase region.

This phenomenon is well documented, see pages 5-32 to 5-45 of the Chemical Engineers' Handbook, 5th Edition, published by McGraw-Hill Book Company, New York, N.Y. In the present instance, this type of flow can be beneficial provided it is controlled such that precipitation of polymer onto the equipment is suppressed, because such bubble action enhances turbulence and constitutes what may be termed "scrubbing action" which improves the effectiveness of the color change-cleaning process. Through careful control of the pressure within the apparatus during the purging, flushing, cleaning phase, it could be oscillated over a narrow range such that enhanced bubble formation and collapse would occur, culminating in furthering the "scrubbing action". Such could easily be accomplished with utilization of state-of-the-art equipment.

Another phenomena that can occur which would also be beneficial, is when any solvent-carbon dioxide admixture, which diffuses through the interface between it and any coating material with which it is miscible and/or through any polymer that happens to adhere to the apparatus walls and in nooks and crannies and/or solvent laden carbon dioxide bubbles caused from depressurization that also have diffused through said interface, "blasts off" and/or "blasts out" of said coating material or polymer when sudden depressurization is allowed while the system is returning to atmospheric conditions. This circumstance could be controlled to occur at the end of a spraying sequence, between coating material changes, or for final apparatus cleanup.

In the prior art, in which compressed air and/or compressed air-solvent mixtures are introduced to flush apparatus during color changes, neither the compressed air nor its admixture with solvent necessarily constitute a solvent for the coating material; therefore, it could precipitate solids from the coating material. Moreover, the air component could enhance drying and hardening of any coating material or polymer remaining in the spray coating apparatus. Likewise, diffusion of the air into these adherents would be of a lower magnitude thereby resulting in a much lower, if any, "blast off" effect than would be the case when miscible supercritical carbon dioxide is used in the present invention.

The purging, flushing, and cleaning method of the present invention is particularly appropriate for liquid spray processes that use supercritical fluids, such as carbon dioxide, as a diluent, such as discussed in related U.S. patent applications Ser. No. 133,068, filed Dec. 21, 1987, Ser. No. 218,896, filed Jul. 14, 1988, Ser. No. 218,910, filed Jul. 14, 1988, Ser. No. 327,274, filled Mar. 22, 1989, and Ser. No. 413,517, filed Sep. 27, 1989. In addition to applications appropriate to the above, two-package systems are also includable, such as those, for example, exemplified by reactive poly(urethane) polymer systems, wherein the polymer portion and the isocyanate portion are kept separate until just before application.

By using high pressure components, even pumps and lines used to supply the coating formulation for mixing with carbon dioxide can be cleaned. The coating pump can be used to pressurize and proportion the solvent for mixing with the carbon dioxide by replacing the coating formulation supply vessel with a vessel containing solvent, in the apparatus as is shown, for example, in FIG. 4, which is a schematic diagram of a continuous spray apparatus, which includes a circulation loop that continuously provides pressurized, heated, and mixed coating formulation to the spraying device, wherein supercritical carbon dioxide is used as a diluent to thin very highly viscous polymer and coating compositions to liquid spray application consistency. In many instances the spray application apparatus will be single-pass in mode with a thermostated spray gun and hoses and, of course, without circulation of the coating formulation. The present invention is obviously applicable to said single-pass apparatus, wherein a simpler method and apparatus may be employed for purging, flushing, and cleaning over that required for spraying methods and apparatus with circulating loops.

EXAMPLE 1

Figure 4:
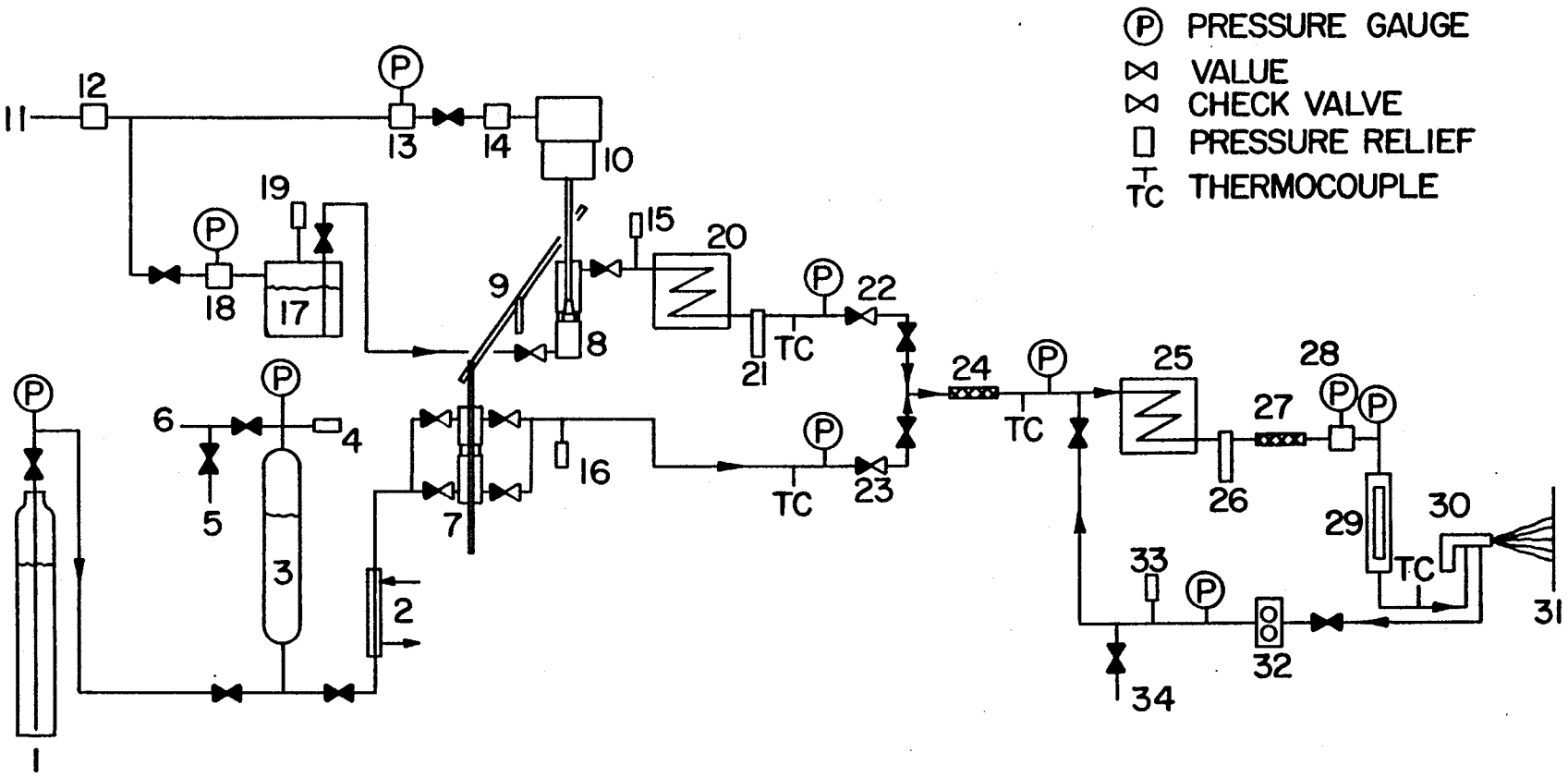
FIG. 4 is a schematic diagram of a continuous spray apparatus that can be purged and cleaned with supercritical carbon dioxide in accordance with the practice of the present invention.

The apparatus shown schematically in FIG. 4 was assembled from the components such that pressure tank (17), Graco two-gallon pressure tank model 214-833, was connected to pump (8), Graco standard double-acting primary piston pump model 207-865 with Teflon TM packing, using Graco ⅜-inch static-free nylon high-pressure hose model 061-214 with connections were made using Graco ¼-inch static-free nylon high-pressure hoses model 061-214 with 5000 psig pressure rating. All rigid connections were made with Dekuron ¼-inch diameter, 0.036-inch thick, seamless, welded, type 304 stainless steel hydraulic tubing ASTM A-269 with 5000 psig pressure rating, using Swagelok TM fittings. Air supplied to (17) from (12) was regulated by (18), Graco air pressure regulator model 171-937, and overpressurization protection provided by (19), Graco pressure relief valve model 103-437 set at 100 psig.

The coating formulation and carbon dioxide were pumped and proportioned by using pump unit (9), Graco Variable Ratio Hydra-Cat TM Proportioning Pump unit model 226-936 with 0.9:1 to 4.5:1 ratio range. It proportions two fluids together at a given volume ratio by using two piston pumps (7), Graco double-acting piston pump model 947-963 with 4-ball design and Teflon TM packing mounted in No. 5 Hydra-Cat TM Cylinder Slave Kit 947-943, and (8), Graco standard double-acting primary piston pump model 207-865 with Teflon TM packing, that are slaved together. The piston rods for each pump are attached to opposite ends of a shaft that pivots up and down on a center fulcrum. The volume ratio is varied by sliding pump (7) along the shaft, which changes the stroke length. The pumps are driven on demand by an air motor (10), Graco President air motor model 207-352. Compressed air (11) at 95 psig is supplied and filtered by (12), Graco air filter model 106-149. Pumping pressure is controlled by the air pressure that drives the air motor, which is set by regulator (13), Graco air pressure regulator model 206-197. The air to the air motor is oiled (14), Graco air line oiler model 214-848. After being pressurized in the pump to spray pressure, the solution is heated in electric heater (20), Graco high-pressure fluid heater model 226-816, filtered in (21), Graco high-pressure fluid filter model 218-029 and fed through check valve (22), Graco check valve model 214-037 with a Teflon TM seal, into the mixing point with carbon dioxide, overpressurization protection is provided by (15), Graco pressure relief valve model 208-317 set at 3000 psig. Bone-dry-grade liquid carbon dioxide is supplied from (1), size K cylinder with eductor tube, to (3), Hoke cylinder 8HD3000, 3.0-liter volume, 1800 psig pressure rating, mounted on a scale, Sartorius electronic scale with 0.1-gram sensitivity, for measuring its uptake rate. During filling of (3) air is vented through valve (5), (3) is optionally pressurized by nitrogen from (6), and protected by safety valve (4), Circle Seal TM pressure relief valve P168-344- 2000 set at 1800 psig. (3) is connected to (7) through optional cooling heat exchanger (2). After being pumped by (7) to spray pressure, the carbon dioxide flows through check valve (23), Graco check valve model 214-037 with a Teflon TM seal, to the mixing point, overpressurization protection is provided by (16), Graco pressure relief valve model 208-317 set at 3000 psig. After the mixing point, mixing is provided by (24), Graco static mixer model 500-639 and the admixture enters the circulation loop, wherein circulation is provided by pump (32), Zenith single-stream gear pump model HLB-5592, through: heater (25), Graco high-pressure fluid heater model 226-816; filter (26); Graco high-pressure fluid filter model 218-029; Kenics static mixer (27); sight glass (29), Jerguson high-pressure site glass series T-30 with window size #6 rated for 2260 psig at 200° F.; and spray gun (30), Graco electrostatic airless spray gun model AL4000 with 2000 psig maximum allowable working pressure with spray tip #270-411 with 0.010-inch orifice size. Power for electrostatic gun (30) is supplied by Graco 75 kilovolt power supply model PS7500 (not shown). Pressure regulation of the circulating loop is provided by (28), Graco fluid pressure regulator model 206-661, and overpressurization protection is provided by (33), Circle Seal TM pressure relief valve P168-344-2000 set at 2000 psig. A drain (34) is provided to drain material from the apparatus.

A precursor coating formulation that gives a blue metallic acrylic enamel coating was prepared by mixing each gallon of DuPont Centari TM acrylic enamel B8292A medium blue metallic auto refinish paint used with 2 grams of Auto Fisheye eliminator, 363 grams of ethyl 3-ethoxypropionate (EEP), and 120 grams of butyl CELLOSOLVE TM. The precursor coating formulation contained 34.6% by weight nonvolatile solids and 65.4% by weight volatile organic solvents.

The pressure tank (17) was filled with the precursor coating formulation and pressurized with air to 50 psig. Primary pump (8) was primed by opening a drain valve (not shown) on the bottom of filter (21) until air was purged from the line. The carbon dioxide secondary pump (7) was positioned along the pivoting shaft to give 45 percent of maximum displacement. The carbon dioxide feed line and circulation loop were filled with gaseous carbon dioxide and vented through valve (34) several times to purge air from the system. The valves to the mixing point were then closed. Refrigeration was supplied to (2) at a temperature of about −20° C. to cool the carbon dioxide to suppress cavitation and compressibility in pump (7). The carbon dioxide feed line was filled to prime pump (7).

Air pressure regulator (13) was adjusted to supply air motor (10) with air, and the valves to the mixing point were opened and the circulation loop was filled with material. With the circulation loop return valve closed, to give plug flow around the loop with no backmixing, material was drained from valve (34) until a uniform composition was obtained. Heater (20) was adjusted to give a feed temperature of 37° C. The circulation heater (25) was adjusted to give the spray temperature of 50° C. The circulation loop return valve was then opened and the spray mixture was circulated at a high rate by adjusting gear pump (32). The carbon dioxide content of the admixed coating formulation was determined by measuring the carbon dioxide uptake rate from Hoke cylinder (3) and the precursor coating formulation uptake rate from pressure tank (17), which was mounted on a scale, while spraying through the spray gun (30) onto substrate (31). The carbon dioxide content of the admixed coating formulation was 30 percent by weight and the admixed coating formulation was single-phase, as observed in the window of sight glass (29). Then, the carbon dioxide feed was switched back to supply cylinder (1), and spraying was carried out on demand by activating spray gun (30). Thus, the precursor coating formulation and carbon dioxide were pressurized, mixed, heated, and sprayed in a continuous mode. The spray temperature was 50° C. and the spray pressure was 1600 psig. Test panels were hand sprayed on Bonderite 37 polished 24-gauge steel test panels, 6-inch by 12-inch size, flashed for a few minutes, and baked in an oven at a temperature of 60° C. for one hour and then evaluated for properties.

At the end of this spraying test, it was planned to spray a clear-coat material; basically constituting a color change. Previously, purging, flushing, and cleaning with organic solvent would be practiced; however, in this case the method of the present invention was applied.

In the application of this method, the precursor coating formulation was first drained from the supply vessel (17) and it was next cleaned with solvent, then filled with DuPont 8034S Acrylic Enamel Reducer, and pressurized with air to 50 psig. It is expected in the usual practice of the present invention that a separate pressure vessel containing solvent would be used to expedite the cleaning operation. The precursor coating formulation conduit and apparatus was then depressurized and the coating formulation was flushed with solvent from (17) with draining of the conduits and apparatus through a drain valve (not shown) on the bottom of filter (21) into a suitable waste container (not shown), with check valve (22) maintaining spray pressure in the circulating loop by preventing back flow from the loop. When the pressure in the coating formulation conduit and apparatus dropped below 50 psig, organic solvent from vessel (17) flowed into this part of the apparatus, thereby filling it with solvent. Check valve (23) prevented back flow into the carbon dioxide supply conduit and apparatus, thereby preventing contamination of this part of the apparatus. To purge admixed coating formulation from the circulating loop, proportioning pump unit (9) was energized and drain valve (34) was opened. Consequently, both carbon dioxide and organic solvent were pumped into the apparatus upon demand by the opening action of valve (34). Since the pump unit ratio was not changed, the ratio of carbon dioxide to solvent was the same as when test spraying was being carried out. During this period spray gun (30) was also activated to purge and flush it of the coating admixture. After purging of the circulating loop was completed, flushing was accomplished by continuing circulating at the operating temperature and pressure of 50° C. and 1600 psig. At this point air was turned off of motor (10) and the DuPont solvent-carbon dioxide-admixed coating formulation mixture was vented from the system through valve (34) into the waste container. Because the DuPont solvent being used was not a component of the clear coating material to be sprayed next, ethyl 3-ethoxypropionate (EEP), which is a solvent for both coating materials, was added to vessel (17), following its cleaning of the DuPont solvent. Purging and flushing was again initiated using the procedure as given above with the final step being venting of the carbon dioxide-DuPont solvent-EEP solvent. During the purging and flushing process, the fluid appearing in sight glass (29) showed the cleaning process was being effected in the most desirable single-phase state. Because continuation of spraying was not planned until the next day, the apparatus was filled with EEP and allowed to stand overnight. This Example demonstrates the method of the present invention, wherein the precursor coating formulation pump was used to pressurize and proportion the cleaning solvent and carbon dioxide, and to clean the precursor coating formulation supply apparatus and the circulating loop without contaminating the carbon dioxide supply apparatus.

EXAMPLE 2

In another instance, using the apparatus, operating conditions, and operating procedure as in Example 1, purging, flushing, and cleaning of the circulating loop was attempted by purging the loop with liquid carbon dioxide. First, the precursor coating formulation and carbon dioxide supply conduits and apparatus were inactivated. Next the circulating loop was drained through valve (34) into a waste container until the loop was as free as possible of the coating admixture. Next the variable ratio proportioning pump unit (9) was operated so as to only pump carbon dioxide, wherein the carbon dioxide was pressured to about its critical pressure. With the circulating loop heater (25) still in service, the temperature of carbon dioxide in the circulating loop was above its critical value.

Shortly after this step, observation of the sight glass (29) showed the presence of two phases, in that metallic flakes were dissociating from the previously stable suspension with commencing of fouling of the walls of the conduit and apparatus of the circulating loop. At this point, proportioning unit (9) was adjusted to start pumping solvent into the apparatus without further addition of carbon dioxide in an attempt to flush and clean the loop apparatus, which was unsuccessful. The apparatus had to be dismantled and cleaned by hand. Example 2 demonstrates it is essential that the purging, flushing, and cleaning solution be compatible with the coating admixture while maintaining the process in the single-phase, or near the single-phase state.

Embodiments of the present invention in the more preferred state-of-the-art method and apparatus of the aforementioned U.S. patent application Ser. No. 413,517 is illustrated in the alternative configurations shown in FIGS. 5 to 7. The method and apparatus are capable of accurately and continuously providing a proportioned mixture comprised of 1) a non-compressible fluid, such as
   a) precursor coating formulation for the spray application of a coating or
   b) precursor cleaning solution of organic solvent, which may contain a coupling solvent and water, for the purging, flushing, and cleaning of the spray apparatus, and
2) a compressible fluid, such as carbon dioxide or nitrous oxide.

Specifically, the mass flow rate of the compressible fluid is continuously and instantaneously measured by a mass flow meter and fed to a signal processor, which controls a metering device that continuously and instantaneously meters in a predetermined proportion of non-compressible fluid in response to the mass flow rate of the compressible fluid. Thereby when the compressible and non-compressible fluids are subsequently mixed, they are in the proper proportion. The method and apparatus includes means for supplying, pressurizing, mixing, and heating the compressible and non-compressible fluids and, if desired, for circulating the mixture. The method and apparatus specifically includes means for supplying the cleaning solution and the means for supplying one or more precursor coating formulations, such as for material change or color change during the spray coating operation. The method and apparatus includes means for spraying the admixture of precursor coating formulation and compressible fluid. The method and apparatus includes means for controlling flows into, through, and from the apparatus, such as for 1) switching from one precusor coating formulation to cleaning solution to another precursor coating formulation, and so on, 2) feeding compressible fluid by itself to flush cleaning solution from the apparatus, 3) starting and stopping circulation through different parts of the apparatus, if desired, 4) starting and stopping spraying, and 5) draining or venting materials from the apparatus. The method and apparatus includes means for controlling and changing the spray pressure and the cleaning pressure. The method and apparatus includes means for controlling and changing the proportion of compressible and non-compressible fluids.

Figure 5:
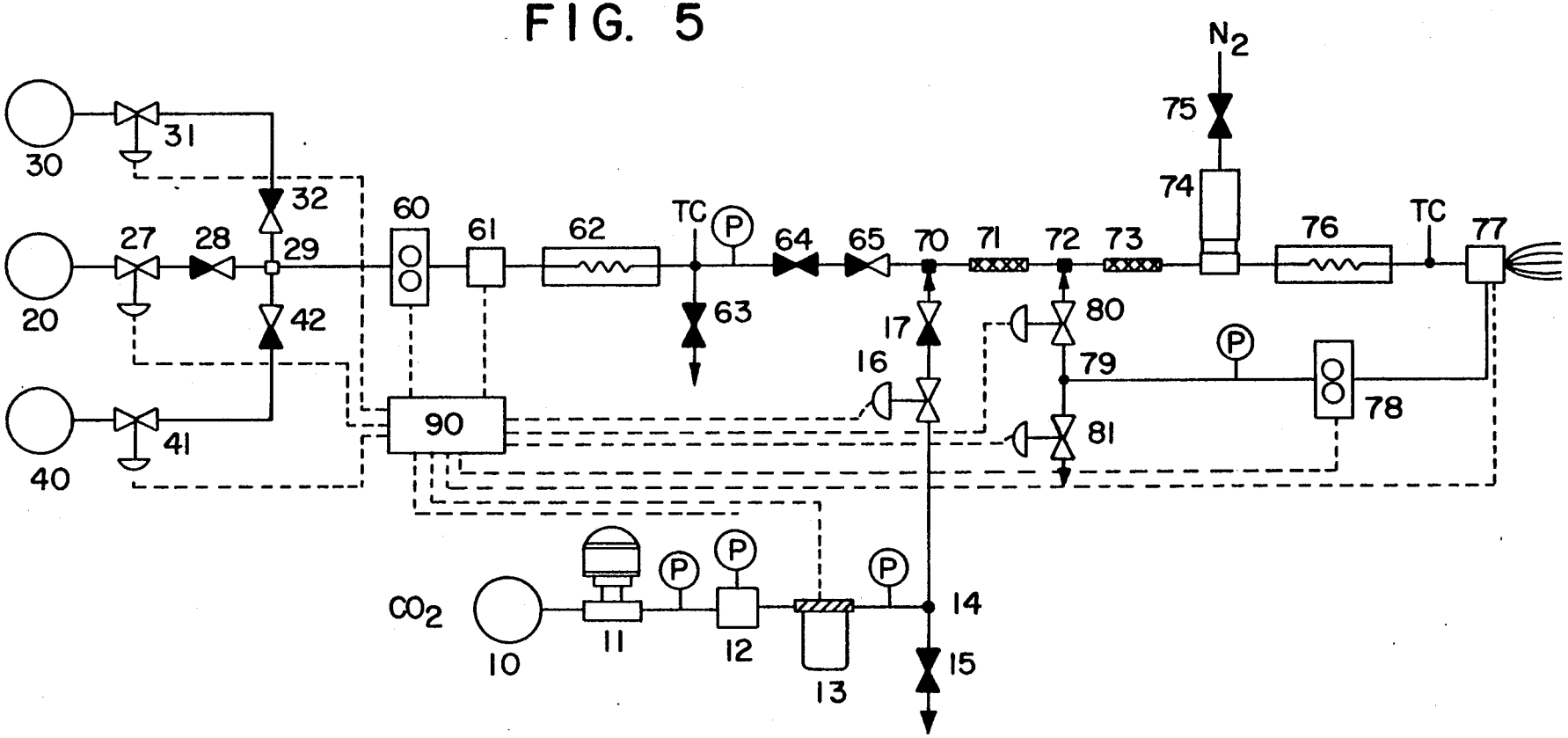
FIG. 5 is a schematic diagram of another continuous spray apparatus that can be used in the practice of the present invention, in which an accurately proportioned mixture of supercritical carbon dioxide and coating formulation are prepared in preparation for spraying.
Figure 6:
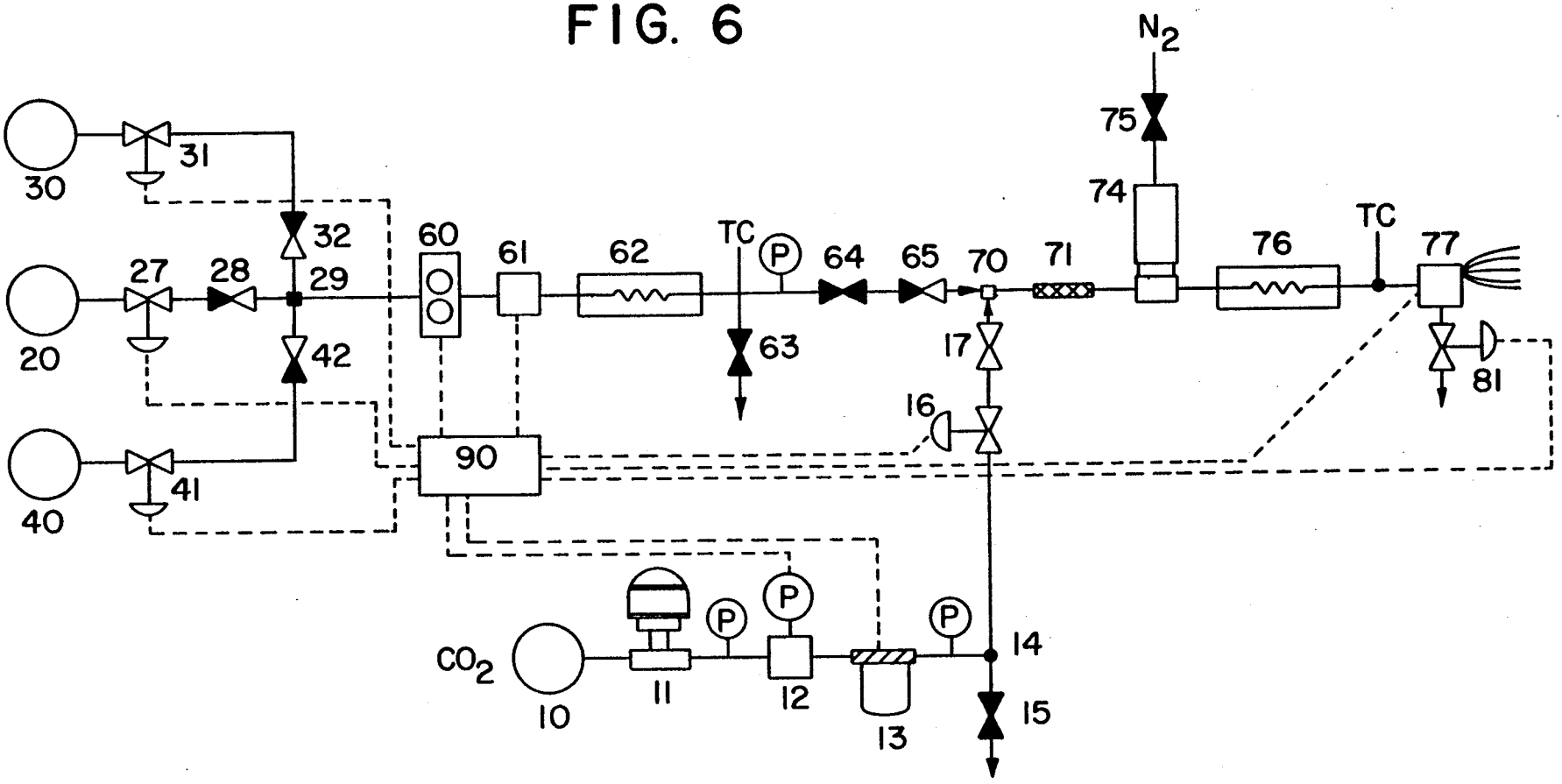
FIG. 6 is a schematic diagram of a more preferred embodiment of the apparatus shown in FIG. 5.
Figure 7:
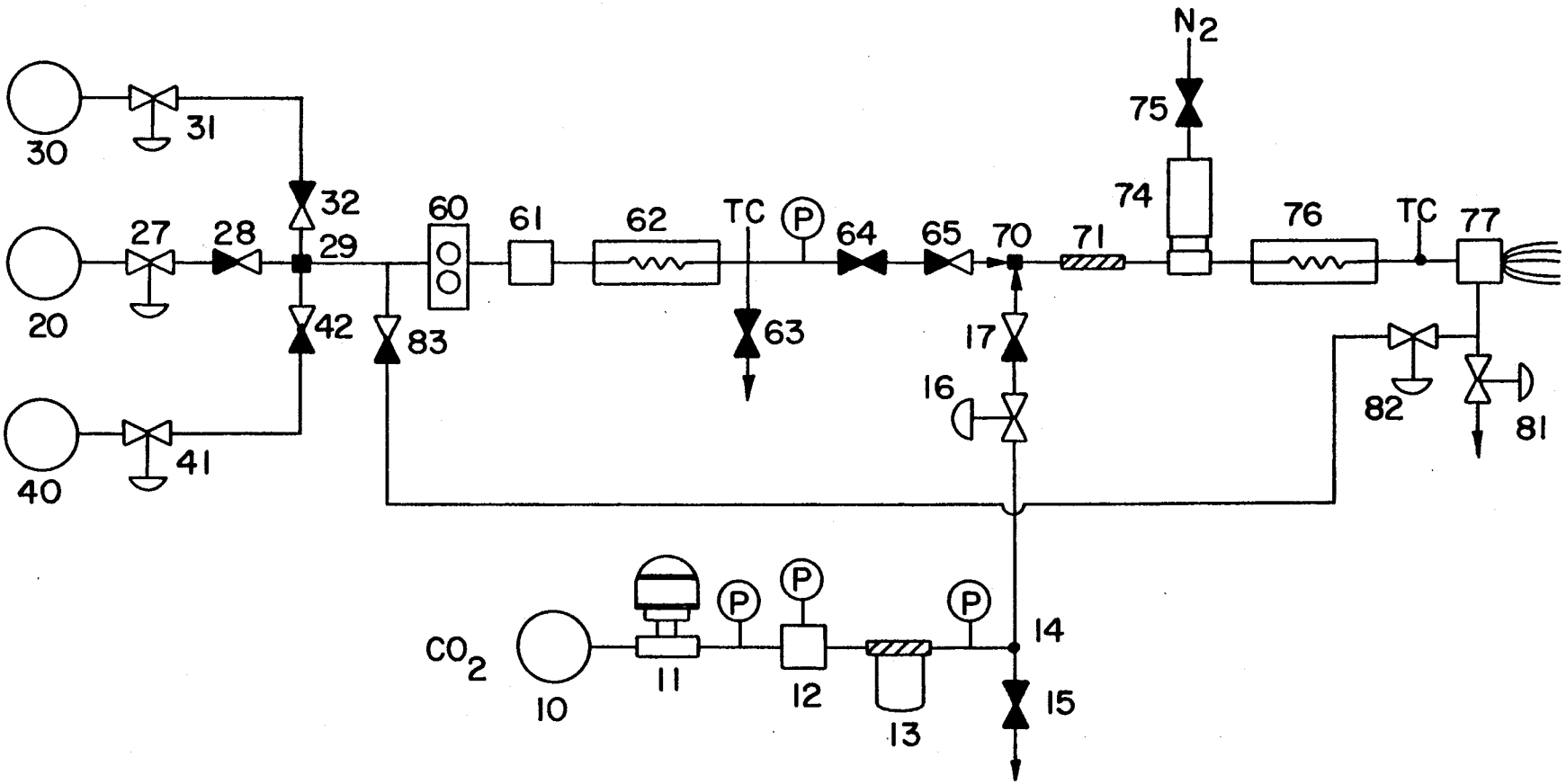
FIG. 7 is a schematic diagram of yet another embodiment of the present invention, which includes a coating material change method.

As shown in FIGS. 5 to 7, carbon dioxide is supplied upon demand, preferably as a liquid, from a carbon dioxide feed system, shown generally as (10) in the drawings. The carbon dioxide may be supplied from liquified compressed gas cylinders at ambient temperature and a vapor pressure of about 830 psig for small-scale use. For larger-scale use the carbon dioxide is preferably supplied refrigerated from refrigerated liquified compressed gas cylinders or tanks such as at a temperature of about −15 C. and a vapor pressure of about 300psig. The carbon dioxide is preferably first fed to an air-driven carbon dioxide primer pump (not shown), such as Haskel Inc. model AGD-15, located at the carbon dioxide supply (10). The primer pump pressurizes the carbon dioxide to a pressure of between about 1000 to about 1500 psig, which is above the vapor pressure of the carbon dioxide at ambient temperature, for distribution to the spray apparatus. Higher pressure may be used if desired. The carbon dioxide is then fed to an air-driven carbon dioxide liquid pump (11), such as Haskel Inc. model DSF-35, located at the spray apparatus. The liquid pump pressurizes the carbon dioxide typically to a pressure of between about 1500 to about 3300 psig, which is above its critical pressure and is preferably also about 200 to 300 psi above the maximum pressure used for spraying, cleaning, or purging. Higher pressure such as up to 5300 psig may also be used depending on the requirements of the application. The primer pump and liquid pump (11) are driven by air motors that are supplied with compressed air on demand through pressure regulators (not shown) set to give the proper air pressures required for the desired pumping pressures. Pump (11) is designed for pumping liquified gases under pressure without requiring refrigeration to avoid cavitation. The pressurized carbon dioxide is then regulated with a pressure regulator (12), such as a Scott high pressure regulator model 51-08-CS, to a steady outlet pressure that is set to the desired spray pressure and cleaning pressure, which are generally above the critical pressure and between about 1200 and about 3000 psig. Higher pressure such as up to 5000 psig may also be used depending on the requirements of the application. The cleaning pressure may be the same as the spray pressure, in which case the regulated carbon dioxide pressure is fixed and unchanged during spraying and cleaning. To minimize organic solvent usage for purging, flushing, and cleaning, preferably higher pressure is used for cleaning than for spraying in order to maximize carbon dioxide solubility. Then a pressure regulator (12) is desirable that can be set automatically by a controller so that the carbon dioxide regulated pressure can be swung automatically between the lower spraying pressure and the higher cleaning pressure during the transitions from spraying to cleaning and from cleaning to spraying. For example, for a typical airless spray gun application, the spray pressure for best spray performance may be between about 1200 to 1600 psig, but the cleaning pressure for best carbon dioxide solubility may be between about 2000 to 3000 psig. For some applications, carbon dioxide solubility may be such that the same pressure is used for spraying and cleaning. This may be desirable, for example, when the cleaning time is required to be very short, such as during color change on a paint line. It is possible that in some applications the cleaning pressure may be lower than the spray pressure, such as to intentionally form a two-phase system for cleaning. The pressure regulator (12) allows carbon dioxide to flow in response to any fall off in pressure that occurs due to spraying or draining material from the apparatus. When not spraying or draining, the outlet pressure at pump (11) equalizes to the pressure at the regulator inlet and the pump stalls. A coriolis mass flow meter (13), such as Micro Motion model D6, measures the true mass flow rate of the carbon dioxide. In FIGS. 5 to 7, a single carbon dioxide feed point (70) is used. The flow of carbon dioxide is turned on and off by control valves (16) and (18), which may be used to throttle the carbon dioxide flow if desired. Check valves (17) and (19) prevent back flow of material into the carbon dioxide feed system. Vent valve (15) is used to vent air from the feed system during startup and to depressurize the feed system. If desired, the carbon dioxide primer pump at the carbon dioxide supply (10) may be used to pressurize the carbon dioxide directly to the desired feed pressure at regulator (12) without using carbon dioxide liquid pump (11). However, the capacity of the primer pump generally decreases with higher outlet pressure.

In FIGS. 5 to 7 the non-compressible coating formulations and cleaning solution are mixed with carbon dioxide at a single common feed point and use a common feed pump system. Cleaning solution is supplied on demand from a cleaning solution feed system, shown generally shown as (20) in the drawings, through control valve (27) and check valve (28) to common feed point (29). Coating formulation A is supplied on demand from a coating formulation feed system, shown generally as (30) in the drawings, through control valve (31) and check valve (32) to common feed point (29). A second coating formulation B is likewise supplied on demand from a parallel second coating formulation feed system, shown generally as (40) in the drawings, through control valve (41) and check valve (42) to common feed point (29). Although two coating formulation supply systems and one cleaning solution supply system are illustrated, a plurality of coating formulation supply systems and cleaning solution supply systems may be used in parallel in like manner to supply more than two coating formulations and more than one cleaning solution.

The coating formulation feed system and the cleaning solution feed system can be any of those commonly used in the coatings industry, such as pressurized pots, such as a Binks model 83-5504 two-gallon pressure pot that is pressurized to about 50 psig with compressed air, on a small scale or drums, tote tanks, or permanent tanks on a larger scale. The coating formulation may also be supplied using a system (not shown) that circulates the coating formulation from the supply pot or tank continuously to the feed control valve (31) or (41) and back to the pot or tank using a circulation pump, such as to prevent settling of pigmented coating formulations. The cleaning solution feed system (20) and coating formulation feed systems (30) and (40) may also use primer pumps (not shown), such as air-driven piston or plunger liquid primer pumps, to deliver the cleaning solution and coating formulations on demand prepressurized to the feed control valves (27), (31), and (41), respectively. This may be desirable to reduce the pressure increase that the metering pump (60) must pump against. It depends upon the pressure generation capabilities and slippage of the metering pump employed and the properties of the coating formulations and cleaning solution. In general, because the cleaning solution has low viscosity and cleaning might be done at much higher pressure than spraying, it is preferable to prepressurize the cleaning solution using a primer pump to a pressure sufficiently close to the cleaning pressure that the metering pump (60) is able to pump the cleaning solution up to the cleaning pressure efficiently. It is desirable to use a primer pump to prepressurize a coating formulation if it has low viscosity or if the spraying pressure is high, in order to reduce slippage and increase pumping efficiency, or if the coating formulation is abrasive, in order to extend the useful life of the pump or to minimize maintenance. The coating formulation is metered and pressurized to spraying pressure and the cleaning solution is metered and pressurized to cleaning pressure by a precision metering pump (60), such as a metering gear pump, such as Zenith model HMB-5740, at the proper flow rate in response to the measured mass flow rate of the carbon dioxide. The coriolis mass flow meter (13) measures the carbon dioxide mass flow rate and sends a signal from its electronic transducer (not shown), such as Micro Motion electronic module, to the metering pump electronic ratio controller (not shown), such as Zenith Metering/Control System model QM1726E, that controls the operating speed of the metering gear pump (60). The flow rate of coating formulation or cleaning solution produced by metering gear pump (60) is measured by a precision flow meter (61), such as a gear flow meter, such as AW Company model ZHM-02, to monitor the delivered flow rate and to provide feedback control to the metering pump controller that controls the operating speed of the metering gear pump (60). By using this feed back control, pumping inefficiency in metering gear pump (60), such as caused by slippage, wear, or plugging by solids, is automatically corrected for and the desired flow rate is obtained regardless of change in viscosity or pumping pressure. The coating formulation or cleaning solution is preheated in an electric high-pressure paint heater (62), such as Binks model 42-6401, before flowing through check valve (65) into the mixing manifold (70), where it is admixed with the carbon dioxide. The admixed carbon dioxide and coating formulation or the admixed carbon dioxide and cleaning solution flows from mixing manifold (70) through static mixer (71), such as a Kenics mixer. The carbon dioxide enters the supercritical state once it is heated above its critical temperature of 31 C. by mixing with preheated coating formulation or preheated cleaning solution at mixing manifold (70).

In FIG. 5, the admixed coating formulation or admixed cleaning solution flows from static mixer (71) into mixing manifold (72), where it is mixed with recirculated admixed coating formulation or recirculated admixed cleaning solution, respectively, as it enters a circulation loop. The combined mixture is mixed in static mixer (73) in the circulation loop itself. An accumulator (74), such as Tobul, model 4.7A60-4, may be used to increase the loop capacity and to minimize pressure fluctuations. The accumulator is filled with compressed nitrogen to the desired pressure through valve (75). Preferably the accumulator has active flow through it and is operated with minimal filled volume to facilitate cleaning. The admixed coating formulation or admixed cleaning solution is heated and controlled to the desired spray temperature or cleaning temperature in a high pressure circulation loop heater (76), such as Binks model 42-6401. For a typical coating application the spray temperature generally falls in the range between about 30 C. and about 80 C., although higher temperatures can be used if desired. Typically the spray temperature falls in the range between about 40 C. and about 60 C. Generally the cleaning temperature will be the same as the spray temperature, because of the practical limitation that the temperature can not be swung rapidly due to large thermal inertia in the heaters and the other components in the system. The optimal cleaning temperature for minimizing organic solvent usage is generally at a lower temperature than the spray temperature, because carbon dioxide solubility is generally higher at lower temperatures. For example, if the optimum spraying temperature is in the range between about 50 to about 60 C., the optimal cleaning temperature might be in the range between about 30 C. and 40 C. To facilitate cooling, cooling heat exchangers (not shown) may be used in addition to the heaters. In general, from an operating consideration a higher draining temperature is desirable in order to better counteract the cooling effect that occurs as the cleaning mixture with carbon dioxide is depressurized as it is drained from the system through a drain valve. The greater the content of carbon dioxide in the cleaning mixture the greater the cooling effect. Therefore, the cleaning solution temperature when drained must be high enough to prevent freezing and plugging in the drain line. Therefore, for cleaning solutions containing a high content of carbon dioxide, or for flushing solvent from the system using pure carbon dixoide, it is desirable to heat the cleaning solution to a higher temperature in a heater just prior to the drain valve. The drained material must not be heated excessively such that enough dissolved coating material comes out of solution to cause a plugging problem. To avoid plugging by freezing or other means it is desirable that the drain line attached to the drain valve be relatively short.

Loop circulation is provided by gear pump (28), such as Zenith model HLB-5592 when spray system (25) is activated. A sight glass (23), such as a Jerguson, is used to view the mixture in the loop and observe its phase. The admixed liquid mixture is sprayed onto the substrates from spray system (25), which may be any commercially available airless spray apparatus that is activated electrically or pneumatically by a signal from computer-controller (15). Draining from the system into a suitable waste container (not shown) is provided through control valve (26). Also, other drain valves are supplied where appropriate. Likewise, although not shown, the apparatus includes filters, overpressurization relief valves, surge pots, shut off valves, and the like.

A multi-channel flow computer and microprocessor with sequencing functionality and controller capability (15), such as any commercially available state-of-the-art apparatus, is used for instantaneous and cumulative flow rate computation, indication, and sequencing the functioning of control valves and circulation loop pump (28), whose speed control is governed by a signal to electronic control (27), and operating the spray gun. A general purpose data logger (14), such as a Molytek data logger, with mathematical capability provides data printing and calculation functions of the characteristics of the two streams.

In the spraying operation mode, the apparatus continuously proportions the compressible carbon dioxide and non-compressible coating formulation at the desired concentration of carbon dioxide and maintains the desired spray pressure of about 1600 psig. The admixed liquid mixture temperature is maintained at the desired spray temperature of about 60° C. at the spray gun. Carbon dioxide flow is initiated on demand by the action of the spray gun, with spraying and coating formulation flow accurately metered and proportioned in response to the carbon dioxide flow as measured by the mass flow meter. Carbon dioxide flow stops in response to the spray gun ceasing to spray and the coating formulation flow stops in response to the cessation of carbon dioxide flow.

Following a spraying operation, the coating apparatus may be shutdown or readied for the spray application of a different coating formulation admixture. Generally, the formulations are quite similar, except for being of a different color, for example, wherein the same basic organic solvents are in use. Therefore, under such circumstances, purging, flushing, and/or cleaning of the apparatus for a color change or shutdown can be accomplished using the same solvent in the practice of the present invention. Of course, in addition, neat (pure) liquid carbon dioxide can be used to flush organic cleaning solvent from the spray apparatus after cleaning but before the next coating formulation admixture is supplied for continuing spraying. That is, since now essentially all of any polymer present in the apparatus has been removed through cleaning, any remaining organic solvent and carbon dioxide are complete miscible in all proportions and as such neat carbon dioxide can be utilized to flush any residual solvent present, thereby providing a solvent free apparatus. It is desirable to heat the carbon dioxide for flushing solvent, as it is for flushing coating, in order to counteract the cooling effect that occurs as the mixture with carbon dioxide is depressurized. If desirable, at this point, the apparatus may be depressurized, wherefrom the contained carbon dioxide vaporizes resulting in a bone-dry state for said apparatus. In such an instance, referring to FIG. 5, a solvent supply vessel (4) and control valve (5) are appended to the process. Any suitable commercially available apparatus may be used in this service.

In one means of operation, the spraying apparatus (25) is deactivated by an electric signal initiated in the microprocessor (15), which has been preprogrammed to accomplish the purging, flushing, and cleaning means when activated by a hand-operated signal from an operator, or electronically from a signal emanating from apparatus (not shown) located, for example, in the spray booth containing a conveyor line of automobile parts being spray coated, wherein alternating parts, or a sequence of parts, are being sprayed with different colored coating formulations. Sequential events taking place comprises: closing valve (6) to stop the supply of precursor coating formulation; opening valve (5) to supply the flushing solvent with the microprocessor (15) resetting the ratio of carbon dioxide to solvent flow to the desired preset ratio, and opening valve (26) thereby purging material in the coating material supply conduit and the circulating loop to a suitable container (not shown) for recycle of the mixture to the precursor coating formulation step, after venting of the carbon dioxide, or to waste disposal. If desired, microprocessor (15) may reset the carbon dioxide feed pressure regulator (12) to a higher pressure for purging, to increase the solubility of the supercritical carbon dioxide, and then reset it to the desired spray pressure following purging. Valve (26) is operated either intermittently to allow the frequent purging of material with its replacement by fresh admixture of solvent and carbon dioxide or continuously at rate that allows the desired pressure to be maintained. Valve (26) may be used in conjunction with a pressure regulator (not shown) that will maintain the desired pressure during the purge operation. All of these events are carried out with the carbon dioxide desirably in the supercritical state. Also, during this stage, the spray gun may be activated to purge, flush, and clean it of residual coating material. The flushing operation continues until the apparatus is clean, wherein sequencing commences as directed by preprogrammed input to either shutdown the system or to initiate supplying another precursor coating material and the eventual spray application to the substrate.

For shutdown, valve (5) is closed shutting off solvent supply, pump (10) is stopped by closing valve (11), valve (50) is closed shutting off carbon dioxide supply, valve (26) is programmed to remain open allowing the system to depressurize and freely drain to the purge container, and the rest of the apparatus is deactivated.

For continuation of spray application of another coating material after purging (but without shutdown), valve (5) is closed, valve (26) is closed after valve (6) is opened supplying new precursor coating formulation from a changed out vessel (3) or another vessel in parallel to it, and the new coating admixture added and allowed to equilibrate by purging through valve (26) and/or through spray gun (25). All of these sequential activities are executed and controlled by the preprogrammed microprocessor and controller (15). The ratio of carbon dioxide to solvent in the purging, flushing, and cleaning admixture may be varied throughout this sequence, containing less solvent as the operation proceeds. The initial admixture is determined by the equilibrium phase relationship between the coating formulation, the solvent, and supercritical carbon dioxide, such that the entire operation takes place without penetrating to any extent into the two-phase region. It is not unusual to find said admixture containing 60 percent by weight carbon dioxide, which affords a significant reduction in solvent usage, with all of the aforementioned advantages thereunder that are the objectives of the present invention.

A modification of the preceding method may be necessary when a coating formulation change is to be effected in which the organic solvent used in the present solvent-carbon dioxide admixture could cause difficulty when contacting the new coating formulation. The solution to this difficulty is a final flush with a solvent and/or a solvent-carbon dioxide admixture containing a solvent completely compatible with the new coating formulation. The addition of a few components such as control valves and additional solvent vessels, and the reprogramming of the microprocessor-controller could easily accomplish this requirement. Another solution, which may be considered, is a final flush with neat liquid carbon dioxide before flushing with the new solvent. Testing may be desirable to select the most appropriate method.

In another embodiment of the present invention, a stand alone solvent system would be used, wherein, separated from the spraying method and apparatus, there exists a vessel(s), a pump(s), a valve(s) which are in communication with the precursor coating formulation supply pump (7), as shown in FIG. 5, said pump (7) being inactive during this stage, but being used later in conjunction with the carbon dioxide supply pump (10), as shown in FIG. 5, to supply solvent to the precursor coating formulation supply apparatus and a solvent-carbon dioxide admixture to the circulating loop, with purging, flushing, and cleaning accomplished in the same manner as previously prescribed.

In one method of operation, the microprocessor sequence controller shuts off spraying through activation of the appropriate valves, initiates flow of solvent and carbon dioxide in the desired ratio from their respective supply vessels with preprogrammed periodic purging of the coating material admixture-solvent admixture from the circulation loop, followed by the upon demand supply of solvent and carbon dioxide, with changing ratio as preprogrammed in the microprocessor. During this phase, the supply pumps provide the energy to accomplish the supercritical state, and the circulating loop pump provides for circulation around this loop; the coating supply system is only purged and flushed whenever fresh solvent is supplied. When prescribed by the microprocessor sequencer, the coating formulation supply pump is shut off, control valves (5) and (6) are closed, control valve (200) is closed and control valve (210) is opened, thereby allowing flow of fluid in a loop which includes: the coating formulation supply pump, flowmeter, and heater; the mixing point; the two static mixers; the loop accumulator; the loop heaters; the sight glass; the spray gun; and the loop pump, which supplies energy for said fluid flow. Check valves (not shown) are provided to prevent the pressurized flow in conduit (220) from entering supplies (3) and (4) should valves (5) or (6) fail. Alternately, by sequencing the valves appropriately, pump (7) may be used to both supply the solvent and provide fluid flow through the expanded loop. Periodically, the loop dump control valve is opened allowing discharge of fluid to a suitable container, followed by activation of the solvent and carbon dioxide supply systems to provide makeup fluid to the process. In this manner, several cycles are executed until the apparatus has been purged, flushed, and cleaned. Next, as preprogrammed, the spray coating apparatus is operated to provide another coating formulation for spray application, or is shutdown until further operation is desired.

In a more preferred embodiment of the present invention, an additional reduction in solvent usage can be attained through a process in which the supply of a solvent-carbon dioxide admixture, in the desired ratio, is supplied to control valve (5), as shown in FIG. 5, rather than via the solvent supply vessel (4) as connected to (5). In the preferred embodiment, as shown schematically in FIG. 7, solvent supply (40) is provided to pump (170), preferably a positive displacement pump, such as Zenith model HLB-5592, with a high pressure bypass loop, then flows through control valve (140) and solvent flowmeter (190) and on to mixing tee (180). The carbon dioxide is supplied from source (20) to pump (100), such as Haskel Inc., model DSF-35, and flows through control valve (130) and carbon dioxide flowmeter (160) to the mixing tee (180). At which point both solvent and carbon dioxide are admixed and flow to the spray coating apparatus when valve (5) is activated. Both pumps (100) and (170) are preferably capable of raising the system pressure to or above the supercritical pressure. Control of the ratio of carbon dioxide and solvent is provided by an electronic microprocessor-controller (150) which receives electronic signals from flowmeters (160) and (190), which in response actives control valves (120), (130), and (140). Microprocessor (150) also receives electronic signals from its counterpart (15) in the spray coating apparatus, as shown in FIG. 5.

In operation said scheme performs functionally in the same manner as the prior methods of the present invention, all of which, of course, are managed by preprogramming of the microprocessor-controller. In the preferred method, since the admixed solvent is supplied to the precursor coating formulation supply apparatus, neither pump (7), nor pump (10), as shown in FIG. 5, is operated. As previously stated, the microprocessor-controller provides for the sequence of operations, and thereby controls the operation of the process apparatus. Said microprocessor-controller is preprogrammed to accomplish said purging, flushing, and cleaning of the spray coating apparatus. In the preferred embodiment of the present invention, additional benefit is derived through the further reduction in the amount of solvent used, in that the entire portion of the apparatus in which coating material be present is purged and flushed by the solvent-carbon dioxide admixture, rather than just the circulating loop; in the previous methods 100 percent solvent flows in the precursor coating formulation portion of the apparatus before being admixed with carbon dioxide at the mixing point.

Yet another embodiment of the invention is shown schematically in FIG. 7, which shows an automatic alternate precursor coating formulation selection and spraying system that might represent a spray coating process with color change. A plurality of coating formulation supply and return lines header (300) deliver coating material from a suitable storage locations. Lines (300) may include coating formulation lines to enable the coating fluid to be continuously circulated through the system to avoid sediment and caking inside the lines. Although not shown, suitable low pressure pumps with enough head pressure to circulate the coating formulation are used. In a typical installation, as an example, a first pair of lines, such as (340) for input and (341) for return, constitute one coating formulation, a second pair of lines, such as (342) for input and (343) for return, constitute a second coating formulation. Within justification, there is no limit on the number of different coating formulations that can be incorporated. These lines along with solvent and liquid supercritical fluid, such as carbon dioxide, lines deliver all of these materials to the circulating manifold (303), such as described in U.S. Pat. No. 4,265,858, and commercially available from Nordson as incorporated in their CHROMAFLEX TM system, for example. Compressed air is also supplied at pressures ranging from about 20 to 100 psig. If the apparatus is used in conjunction with a conveyor system in a large installation, such as found in automobile assembly plants, lines (300) are usually found adjacent to the conveyor line with appropriate taps provided for connection to the spray apparatus. A simplified version of such a type of installation is shown in FIG. 7.

In this embodiment of the present invention, control and sequencing operations are provided by complex programmable microprocessor-controller (315), which may be a commercially obtainable unit that monitors flow and other sensors, accepts signals from remote sequence controller modules and selectors, and generates signals to operate components in the apparatus, such as the coating formulation selector changer, pumps, motors, valves, heaters, back pressure regulators, and the like. Although not shown in the present version, coating formulation selection may be synchronized to deliver the appropriate formulation when the substrate to be coated is so positioned.

After lining out after start-up, the spray apparatus receives on demand a supply of carbon dioxide continuously from a liquified carbon dioxide feed system shown generally as (302) in the drawing. The liquified carbon dioxide is first fed to an air driven carbon dioxide primer pump (not shown), such as Haskel Inc., model AGD-15, located at the feed system (302) for initial pressurization up to a pressure of about 1000 to about 1400 psig, then is pressurized to a pressure of about 1600 to about 2300 psig by carbon dioxide liquid pump (310), such as Haskel Inc., model DSF-35, which is designed for pumping liquified gases under pressure without requiring refrigeration to avoid cavitation. After passing through suitable filters (not shown), the pressurized carbon dioxide is then regulated down with pressure regulator (312) to a steady outlet pressure within the range of about 1300 to about 2000 psig (which is above its critical pressure) for a typical spray gun application.

After being pressured and regulated, carbon dioxide flows through coriolis meter (316), such as Micro Motion, Inc., model D6, for a true mass flow rate measurement. Although not shown, a pressure relief valve is use to protect the carbon dioxide system from overpressurization.

The precursor coating formulation, in this instance supplied by line (340) or (342) and returning to header (300) by line (341) or (343), is fed from the circulating manifold (303), which includes electronically/pneumatically controlled and operated individual on-off valves for each material supply, to precursor coating formulation pump (307), such as Zenith, model HLB-5592, which supplies the positive pressure needed for feeding the coating formulation to the recirculation loop. A precision gear measuring device (309), such as AW Co., model ZHM-02, is used for measuring the flow rate of the coating formulation. The speed command of pump (307) is electronically controlled by a control system (308), which receives an input signal from remote electronics unit (313). The coating formulation metering rate is electronically adjusted by coating flow feedback signal received from measuring device (309). The desired carbon dioxide mass ratio is therefore maintained when the two feeds are combined at the entrance to the circulation loop at mixing point (318).

The coating formulation flows through one or more heaters (317), such as Binks heaters, before it enters the circulation loop. A pressure relief valve (not shown) is used to protect the coating formulation system from overpressurization. Control is effected by microprocessor (315), and a general purpose data logger (314) with mathematical capability provides data printing and calculation functions of the characteristics of the two streams.

The coating formulation and carbon dioxide are combined at mixing point (318) and passed through a static mixer (319) before entering the circulation loop. Check valves prevent back flow of the two fluids. The combined mixture is then again mixed in another static mixer (320) in the circulation loop. The mixture is heated and controlled to the desired temperature of between about 40° C. and about 70° C. in the circulation loop through two respective sets of high pressure heaters (322) and (329), both connected in series. Once heated to this temperature range, the carbon dioxide is in the critical state and remains in that state as it is being circulated and sprayed. The coating formulation admixture is circulated in the loop by a gear pump (328), such as Zenith, model HLB-5592, with speed control provided electronically by speed control system (327). Accumulator (321) is used to increase the loop capacity and to minimize pressure pulsation in the loop, pressure relief valves are also provided to protect the loop against overpressurization. Sight glass (323) is used to observe the fluid mixture in the loop to monitor its phase. The admixed liquid coating mixture is sprayed onto the substrate from spray system (325). Check valves are also provided to prevent back flow, and control valve (326), along with other hand operated drain valves (not shown), is provided for draining fluid from the apparatus. Temperature and pressure indicators are also provided, including pressure sensor (344), which provides pressure input to microprocessor (315).

For purging, flushing, and cleaning, solvent is fed from solvent supply (345); although indicated herein as a single source, a plurality of solvents may be provided from parallel origins. Zenith pump (332) supplies the positive pressure needed for feeding the solvent to the mixing manifold (303). Flow meter (337) is used for measuring the flow rate of the solvent, with speed command of pump (332) electronically controlled by Zenith Speed Control System (339), which receives the input signal from remote electronics unit (336). Feedback signal received from (337) adjusts the flow rate.

Pressurized liquid carbon dioxide is supplied from the liquified carbon dioxide feed system (302) and is then further pressurized to the desired operating pressure between about 1600 and about 2300 psig by carbon dioxide liquid pump (333), after which it flows through flow meter (338), which inputs to electronics unit (336) that regulates solvent flow to produce the desired carbon dioxide-solvent admixture mass ratio, and then flows to the circulating manifold (303). At which point, both solvent and carbon dioxide, which is in the critical state, are caused to flow, by appropriate valving, to the main spray coating apparatus via pump (307). Since the viscosity of both the solvent and carbon dioxide are low, normally complete mixing is achieved at the pump inlet, and in-line static mixers are unnecessary, but may be supplied if desirable. Appropriate check valves are provided to prevent back flow; likewise, pressure relief valves (not shown) are provided to prevent overpressurization.

With the spray coat apparatus in normal operation, that is, spraying onto a substrate with an admixture of carbon dioxide in the critical state and precursor coating formulation supplied by line (340) from header (300), when a change to another precursor coating formulation is desired, to another color, for example, purging, flushing, and cleaning the spray apparatus of the first coating formulation admixture is necessary. Signals from the preprogrammed microprocessor-sequence controller, or from a hand operated remote input device, activate a operational and valving sequence of events to accomplish same, with a final step of initiating flow of the second coating formulation in line (342) to the spray apparatus.

The sequence of events includes shutting off pumps (307), (310), and (328), closing the valve in circulating manifold (303) that is supplying flow of coating formulation from line (340), and closing valve (330). At this instant, flow of all materials has stopped and the apparatus is ready for purging. Solvent and carbon dioxide supply pumps (332) and (333) are now started, their respective valves in manifold (303) are opened, and valves (334), (335), (331) and (326) are also open. With this configuration, precursor coating formulation, and its admixture with carbon dioxide in the circulation loop, is purged from the spray coat apparatus through drain valve (326) into a suitable container (not shown) for reuse and/or disposal. The positioning of valves (330) and (331) in such a manner provides single pass purging in two parallel pathways, thereby expediently removing these fluids. The preprogramming provided in (315) for the maximum possible carbon dioxide-solvent mass ratio, without entering the two-phase state for the present coating formulation admixture, generates signals to (336) and (339), with feedback input from (337) and (338), to adjust and control the flow of carbon dioxide and solvent. With purging completed, flushing now commences, with valve (330) closed and valve (331) open, by closing valve (326), after which circulation loop pump (328) is operated to provide circulation of the solvent admixture through the loop. With periodically opening of valve (326), thereby allowing flow of fluid to the drain container, fresh solvent admixture is admitted to the apparatus; and, as the residual coating formulation concentration decreases, the carbon dioxide-solvent ratio is adjusted to increase the carbon dioxide content. Several such cycles are performed until the apparatus is clean. During this period, spray gun (325) is also flushed of residual first coating formulation. After the apparatus is clean, solvent and carbon dioxide supply pumps (332) and (333) and loop pump (328) are shutdown and valves (334) and (335) are closed. Valve (326) is then opened and the apparatus allowed to depressurize into a suitable container, likewise spray gun (325) is activated to discharge residual fluid. At this point, if desired, the system could be programmed to flush the apparatus with pure carbon dioxide. With valve (326) then closed and the gun inactive, the apparatus is reconfigured to reinitiate spray coating of another substrate by valve action in manifold (303) admitting the second precursor coating formulation from line (342) to pump (307), which has been restarted along with carbon dioxide pump (310) as well as has pump (328). Activation of spray gun (325) completes the cycle of spray application; purging, flushing, and cleaning; and spray application.

While this embodiment describes the purging, flushing and cleaning operation with a cleaning solution containing a solvent, while this description may well have implied that said solvent contained only a single organic solvent component, it is not so restricted, and circumstances may prevail wherein the solvent may be made-up of several components, including those compounds that individually by themselves are not miscible or only partially miscible with some or all of the components comprising the cleaning solution and/or the coating formulations admixture being purged, flushed, and cleaned from the spraying apparatus. Such a circumstance would occur in the case wherein the coating formulation admixture contains up to about 30 percent water, based upon the total weight of solvent/diluent present, and an organic coupling solvent in addition to, or in the replacement of the whole or a part thereof of the nominal active organic solvents used with the polymeric components usually found in said coating formulations. As aforementioned, when this is the case, water acts as additional viscosity reduction diluent and as such even lower viscosity coating formulations can be utilized and sprayed without reducing the amount of the corresponding supercritical fluid being used, with in some instances, it being possible to desirably reduce the amount of volatile organic solvents used. Under this circumstance it is economically and environmentally desirable to use similar materials in making up the cleaning solution; that is, including, but not limited to, compounds such as water, active organic solvents, organic coupling solvents and supercritical fluids. All but the supercritical fluid(s) would nominally be premixed in the solvent supply vessel, such as source (345) in FIG. 7, for example, or in a parallel (not shown) sources as previously mentioned in discussing said apparatus illustrated by this Figure.

With such a cleaning solution, operation would essentially be the same as described with the apparatus shown in FIG. 7. It is possible to envision several alternative schemes for supplying the non-supercritical fluid portion of the cleaning solution. Certainly, each and every said component could be stored and supplied from separate sources, with or without separate pumps and control valves, into the spray apparatus pump (307), or supplied to a manifold with pumps and controllers provided and thence to (307), or premixed as previously mentioned and supplied as such, and the like, none of which is construed to be limiting in scope the practice of the methods and apparatus of the present invention. It is also clear that following the initial purging, flushing, and cleaning means, if desirable, the composition of the cleaning solution can be changed in subsequent sequential purging, flushing, and cleaning operations, with the intent of minimizing the use of volatile organic solvents thereby conserving energy, lowering costs, and reducing the potential for release of undesirable compounds to the environment. The description of such an operating means has been previously described in the present invention and embodiments thereof, with application, without limitation, of the said method and apparatus to the present instance, including the requirement of any additional apparatus, certainly being clear to those skilled in the art.

Within practical limits, there is no limitation in the number of coating formulations or cleaning solution compositions that can be used with the methods and apparatus of the present invention, the major restriction being the realistic number of coating formulation lines required, the cleaning solvent(s)/solution(s) required, and the practical size of the circulating manifold.

During the purging, flushing and cleaning of the spray coat apparatus, normal pressure drop phenomena occurs from unavoidable frictional losses associated with the flow of fluids in the conduits, from enlargements and contractions as the fluids flow into, within, and out of the equipment, and the like. Said pressure drop is expected to cause some vaporization of carbon dioxide from the admixture, such vapor is expected to manifest itself in the formation of small gas bubbles, wherefrom a certain beneficial "scrubbing action" occurs through nonabrasive scouring of the apparatus, thereby enhancing the efficiency of the cleaning cycle.

With high speed operation of the apparatus possible, a cycle, such as has just been described, can be accomplished in a short period of time. Depending upon the coating system involved, it is not uncommon for such duration to be only on the order of several seconds to a few minutes. Consequently, with the method of the present invention, a significant amount of costly potentially polluting organic solvent is replaced by the inexpensive nonpolluting carbon dioxide, thereby minimizing the cost of coating formulation change, the amount of hazardous waste so produced, and its impact upon the environment. Notwithstanding the foregoing depictions, wherein the spraying devices illustrated are automatic spray guns, many industrial applications, such as in the furniture industry, utilize hand-held spray guns, and the present invention is apropos to same, requiring only the insertion of the spray gun operating personnel into the process control loop through the manual operation of interfacing devices so provided.

The aforementioned description and illustrations of the present invention has focused on cases wherein the spray apparatus is maintained at spray pressure during the transition from spraying to cleaning, such that carbon dioxide is still present in the spray apparatus before the purging, flushing, and cleaning admixture of carbon dioxide and solvent is supplied to the apparatus. Conversely, the apparatus can be purged, flushed, and cleaned using the present invention wherein no carbon dioxide or nitrous oxide, for example, is present in said apparatus before supplying the cleaning solution. Such an event would be exemplified wherein the spray apparatus is depressurized between spraying and purging, flushing, and cleaning, such that the carbon dioxide that is present is vented with mainly only solids, such as polymer, and organic solvent present when the cleaning operation begins. In this case, the cleaning solution used would then be lower in solvent content, since more carbon dioxide, than used in the previous illustrations, would be required to replace that lost from the spray apparatus during depressurization; however, the overall solvent usage would remain the same in any case. In some instances, depressurization before cleaning may be desirable, but when doing so when just using organic solvent (without carbon dioxide) for purging, flushing, and cleaning, a greater amount of solvent must be used to replace the carbon dioxide lost during said depressurization, which is not economically and environmentally desirable. Another instance in which carbon dioxide, for example, would not be in the spray apparatus prior to cleaning is when said spraying does not utilize carbon dioxide; that is, conventional spraying whether airless, air-assisted airless, or air spraying (which would not be under pressure during spraying), so that only solids and organic solvent are present when cleaning solution is added. The benefit of utilizing a cleaning solution comprised of organic solvent and carbon dioxide over just organic solvent in such instances is obvious.

While preferred forms of the present invention have been described, it should be apparent to those skilled in the art that methods and apparatus may be employed that are different from those shown without departing from the spirit and scope thereof.

What is claimed is:

1. A method of cleaning apparatus containing one or more polymeric compounds which comprises:

a) forming a one phase, liquid cleaning mixture comprising:
   (i) a compressed fluid fraction containing at least one compressed fluid, said compressed fluid being a gas at standard conditions of 0° C. and one atmosphere (STP); and
   (ii) a solvent fraction containing at least one active solvent component in which said at least one or more polymeric compounds are at least partially soluble and which is at least partially miscible with the at least one compressed fluid component; and b) passing said liquid cleaning mixture through the apparatus at a pressure at which the cleaning mixture and the polymer dissolved therein is substantially near its two fluid phase boundary region.

2. The method of claim 1, wherein the amount of solvent fraction is present in at least an amount such that the liquid cleaning mixture is capable of at least partially dissolving and/or suspending the one or more polymeric compounds.

3. The method of claim 1, wherein the liquid cleaning mixture is circulated through the apparatus.

4. The method of claim 1, wherein the apparatus is successively cleaned with a plurality of the liquid cleaning mixtures wherein each successive cleaning mixture contains a higher weight percent of the compressed fluid fraction than the immediate preceding cleaning mixture.

5. The method of claim 1, wherein the compressed fluid is carbon dioxide.

6. The method of claim 1, wherein the compressed fluid is nitrous oxide.

7. The method of claim 1, wherein the compressed fluid is a mixture of carbon dioxide and nitrous oxide.

8. The method of claim 1, wherein the liquid cleaning mixture is passed through the apparatus at a pressure substantially near the critical pressure of the compressed fluid.

9. The method of claim 1, wherein the liquid cleaning mixture is passed through the apparatus at a pressure in the range of from about 1500 to about 3000 psi.

10. The method of claim 1, wherein the active solvent is selected from the group consisting of aliphatic or aromatic hydrocarbons, ketones, esters, ethers, alcohols and mixtures thereof.

11. The method of claim 10, wherein the active solvent is a glycol ether.

12. The method of claim 1, wherein the one or more polymeric components selected from the groups consist of acrylics, polyesters, melamines, alkyds, epoxies urethanes, urea formaldehydes, vinyls, silicone polymers and mixtures thereof.

13. The method of claim 1 further comprising water in an amount of less than about 50% by weight based on the weight of the solvent fraction.

14. The method of claim 13 further comprising water in an amount of less than about 30% by weight based on the weight of the solvent fraction.

15. The method of claim 13 further comprising a coupling solvent.

16. The method of claim 1, wherein the compressed fluid is carbon dioxide and the pressure is in the range of from about 800 to about 5000 psi.

17. The method of claim 16, wherein the compressed fluid is carbon dioxide and the pressure is in the range of from about 1070 to about 4000 psi.

18. The method of claim 1, wherein the amount of solvent fraction in the mixture is in the range of from about 5 to about 70% by weight based on the weight of the total liquid cleaning mixture.

19. The method of claim 18, wherein the amount of solvent in the mixture is in the range of from about 10 to about 50% by weight based on the weight of the total liquid cleaning mixture.

20. The method of claim 1, wherein the compressed fluid is in its supercritical state.

21. The method of claim 1, wherein the cleaning of the apparatus is carried out at substantially near ambient temperature.

22. A method for cleaning spray apparatus in which a liquid composition comprised of at least one or more polymeric compounds, one or more organic solvents in which the polymeric compounds are at least partially soluble, and at least one compressed fluid is sprayed at a pressure $P_1$ comprising:

a) spraying said liquid composition at pressure $P_1$;

b) stopping the spray of the liquid composition in the spray apparatus;

c) forming a one phase, liquid cleaning mixture comprising:
   (i) a compressed fluid fraction containing at least one compressed fluid, said compressed fluid being a gas at standard conditions of 0° C. and one atmosphere (STP); and
   (ii) a solvent fraction containing at least one active solvent component in which said at least one or more polymeric compounds are at least partially soluble and which is at least partially miscible with the at least one compressed fluid component; and d) passing said liquid cleaning mixture through the spray apparatus at a pressure $P_2$, where $P_2$ is greater than $P_1$ such that polymer is dissolved in said cleaning mixture.

23. The method of claim 22, wherein the amount of solvent fraction is present in at least an amount such that the liquid cleaning mixture is capable of at least partially dissolving and/or suspending the one or more polymeric compounds.

24. The method of claim 22, wherein the liquid cleaning mixture is circulated through the apparatus.

25. The method of claim 22, wherein the apparatus is successively cleaned with a plurality of the liquid cleaning mixtures wherein each successive cleaning mixture contains a higher weight percent of the compressed fluid fraction than the immediate preceding cleaning mixture.

26. The method of claim 22, wherein the compressed fluid is carbon dioxide.

27. The method of claim 22, wherein the compressed fluid is nitrous oxide.

28. The method of claim 22, wherein the compressed fluid is a mixture of carbon dioxide and nitrous oxide.

29. The method of claim 22, wherein the liquid cleaning mixture is passed through the apparatus at a pressure substantially near the critical pressure of the compressed fluid.

30. The method of claim 22, wherein the liquid cleaning mixture is passed through the apparatus at a pressure less than about 5000 psi.

31. The method of claim 22, wherein the liquid cleaning mixture is passed through the apparatus at a pressure in the range of from about 1500 to about 3000 psi.

32. The method of claim 22, wherein the active solvent is selected from the group consisting of aliphatic or aromatic hydrocarbons, ketones, esters, ethers, alcohols and mixtures thereof.

33. The method of claim 32, wherein the active solvent is a glycol ether.

34. The method of claim 22, wherein the one or more polymeric components selected from the groups consist of acrylics, polyesters, melamines, alkyds, epoxies urethanes, urea formaldehydes, vinyls, silicone polymers and mixtures thereof.

35. The method of claim 22, wherein the liquid cleaning mixture further comprises water in an amount of less than about 50% by weight based on the weight of the solvent fraction.

36. The method of claim 30 further comprising water in an amount of less than about 30% by weight based on the weight of the solvent fraction.

37. The method of claim 30 further comprising a coupling solvent.

38. The method of claim 22, wherein the compressed fluid is carbon dioxide and the pressure is in the range of from about 800 to about 5000 psi.

39. The method of claim 38, wherein the compressed fluid is carbon dioxide and the pressure is in the range of from about 1070 to about 4000 psi.

40. The method of claim 22, wherein the amount of solvent fraction in the mixture is in the range of from about 5 to about 70% by weight based on the weight of the total liquid cleaning mixture.

41. The method of claim 40, wherein the amount of solvent in the mixture is in the range of from about 10 to about 50% by weight based on the weight of the total liquid cleaning mixture.

42. The method of claim 22, wherein the compressed fluid is in its supercritical state.

43. The method of claim 22, wherein the cleaning of the apparatus is carried out at substantially near ambient temperature

44. The method of claim 22, wherein $P_1$ is in the range of from about 1050 to about 1200 psi and $P_2$ is in the range of from about 1600 to about 2000 psi.

* * * * *